US012487063B2

(12) United States Patent
Abarca Vargas

(10) Patent No.: US 12,487,063 B2
(45) Date of Patent: Dec. 2, 2025

(54) NON-EXPLOSIVE PROGRAMMABLE ELECTRONIC INITIATION SYSTEM FOR ROCK BLASTING

(71) Applicant: COMERCIALIZADORA EXOBLAST CHILE S.P.A., Santiago (CL)

(72) Inventor: Eduardo Alfredo Abarca Vargas, Santiago (CL)

(73) Assignee: COMERCIALIZADORA EXOBLAST CHILE S.P.A., Santiago (CL)

( * ) Notice: Subject to any disclaimer, the term of this patent is extended or adjusted under 35 U.S.C. 154(b) by 254 days.

(21) Appl. No.: 18/251,225

(22) PCT Filed: Oct. 29, 2020

(86) PCT No.: PCT/CL2020/050144

§ 371 (c)(1),
(2) Date: Apr. 28, 2023

(87) PCT Pub. No.: WO2022/087756

PCT Pub. Date: May 5, 2022

(65) Prior Publication Data

US 2023/0408230 A1 Dec. 21, 2023

(51) Int. Cl.
*F42B 3/12* (2006.01)
*F42D 1/055* (2006.01)

(52) U.S. Cl.
CPC ..... *F42B 3/122* (2013.01); *F42D 1/055* (2013.01)

(58) Field of Classification Search
CPC .. F42B 3/12; F42B 3/121; F42B 3/122; F42B 3/124; F42B 3/125; F42B 3/127; F42B 3/128; F42B 3/13; F42B 3/18
(Continued)

(56) References Cited

U.S. PATENT DOCUMENTS 1,088,448 A * 2/1914 Quiggle ..... F42B 3/16 102/202.13
4,674,047 A 6/1987 Tyler et al.
(Continued)

FOREIGN PATENT DOCUMENTS

CA 2802888 C 8/2018
DE 102005052578 A1 6/2007
(Continued)

OTHER PUBLICATIONS

International Search Report of the International Searching Authority for State Intellectual Property Office of the National Institute of Industrial Property (INAPI) in PCT application No. PCT/CL2020/050144 issued on Jun. 25, 2021, which is an international application to which this application claims priority.

*Primary Examiner* — Bret Hayes
(74) *Attorney, Agent, or Firm* — Kolitch Romano Dascenzo Gates LLC

(57) ABSTRACT

A programmable non-explosive initiator may include a capsule, a filament, a shrink sleeve, a capacitor, and a printed circuit board (PCB). The capsule includes a container tube or sleeve containing a first rapidly expanding metallic mixture. The filament is coated by a second rapidly expanding metallic mixture and is contained by the shrink sleeve. The filament is caused to glow by a controlled discharge of the capacitor. The controlled discharge of the capacitor is controlled by the PCB. In some examples, the programmable non-explosive initiator may include electronic initiator units connected in parallel.

10 Claims, 9 Drawing Sheets

(58) Field of Classification Search
USPC ..... 102/200, 202.5–202.14, 206
See application file for complete search history.

(56) References Cited

U.S. PATENT DOCUMENTS

| | | | | |
|---|---|---|---|---|
| 5,789,697 | A * | 8/1998 | Engelke | C06B 25/36 102/202.7 |
| 6,173,651 | B1 | 1/2001 | Pathe et al. | |
| 2003/0075068 | A1* | 4/2003 | Kim | F42B 3/10 102/202.5 |
| 2005/0034624 | A1 | 2/2005 | Forman et al. | |
| 2018/0371859 | A1 | 12/2018 | Tondel et al. | |

FOREIGN PATENT DOCUMENTS

| | | | |
|---|---|---|---|
| EP | 1306642 | B1 | 8/2006 |
| EP | 1105693 | B1 | 7/2007 |
| EP | 2678633 | B1 | 1/2014 |
| EP | 3051248 | B1 | 2/2018 |
| KR | 100213577 | B1 | 5/1999 |
| WO | 2012077082 | A1 | 6/2012 |

* cited by examiner

NON-EXPLOSIVE PROGRAMMABLE ELECTRONIC INITIATION SYSTEM FOR ROCK BLASTING

BACKGROUND

Since the invention of dynamite, we no longer detonate explosives with fire, but instead by percussion, triggered by the prior detonation of a high explosive (shock wave). These methods are what we call "initiation systems".

In 1863 Alfred Nobel patented his first initiator, consisting of a piece of wood filled with black powder. He later invented a device with a copper capsule system inside which contained mercury fulminate. Afterwards, an extensive range of detonators were developed, whose characteristics varied according to the circumstances in which they were to be applied (mining, quarrying, construction) and the type of dynamite with which they were to be used.

Another initiation system is the safety wick or slow wick system. This consists of black powder wrapped in textile yarns, with a braiding machine, then waterproofed with a layer of asphalt and covered with a new layer of textile or wax. From 1936 to date, a detonating cord has been used, which is a flexible, waterproof rope containing explosive inside, originally trinitrotoluene (TNT) and penthrite.

The mass application of explosives in the more than 140-year history of the industry has been due to their low cost and accessibility. There have been technological advances in mixing and detonators. Currently, the explosive technology used consists of the use of a blasting agent, "Anfo" (Ammonium Nitrate-Fuel Oil), a mixture of ammonium nitrate and petroleum that does not produce toxic gases and has an adequate power according to the type of rock to be fragmented.

A technical problem with rock blasting is its effect on the rock in the vicinity, as it can produce intense fragmentation and disruption of the integrity of the rock in the surrounding area if the blasting or drilling systems are incorrect. The damage would be greater if the blasting energy were transmitted to a more remote area, destabilizing the mine structures.

The results of a blast depend on factors such as: rock type, stress regime, structural geology, and the presence of water. Appropriate measures to minimize blast damage include: proper choice of explosive, use of perimeter blasting techniques such as pre-division blasting (closely spaced parallel holes that define the perimeter of the excavation), decoupling charges (the diameter of the explosive is smaller than that of the blast hole), delay time and stop drills.

Some references with respect to electronic detonator developments may include European patent DE 102005052578.4 describing a method and a system for assigning a delay time to an electronic delay detonator, where the detonator includes an information register (24), in which the desired delay time value, supplied by the controller, is recorded, where subsequently, during a predetermined time period (t), the contents of the information register (24) are repetitively added to a counter register (26), where the contents are accumulated, where after a division of the contents of the counter register over the calibration time, the contents of the counter register (26) are subsequently counted backwards using the same oscillator (18) controlling the accumulation process. The present invention allows the value of the delay time supplied by the controller to be accurately matched, using an oscillator (18) with low precision and no feedback from the trigger (12) to the controller.

Another development with respect to electronic detonators refers to US Patent U.S. 61/108,277 describing a detonator that incorporates a high voltage switch, an initiator and an initiation pellet, with the detonator also comprising a low- to high-voltage detonation group connected to the switch and the initiator, such that the detonator includes a high voltage power source and an initiator in one integrated package. The detonator may also include a power cord and communications devices, a microprocessor, tracking and/or locating technologies, such as rfid, gps, etc., and a pellet of an explosive or combination of explosives. The combination explosive pellet has a first explosive with a first-impact energy, and a secondary high explosive in the exit pellet with a second impact energy greater than the impact energy of the first explosive. Systems for quick and easy deployment of one or more detonators in the field are also provided.

Within the large universe of patents on electronic detonators, we can mention patents EP1105693/WO0009967 describing a method and apparatus for setting up a blasting arrangement by loading at least one detonator in each of the numerous blasting holes, placing explosive material in each blasting hole, connecting to a trunk line a control unit with a power source incapable of firing the detonators, sequentially connecting the detonators—using respective bypass lines—to the trunk line and leaving each detonator connected to the trunk line. The device further includes means for receiving and storing in memory the identity data of each detonator, means for causing a signal to be generated to test the integrity of the detonator/trunk line connection and the functionality of the detonator, and being able to assign a predetermined time delay to each detonator to be stored in memory.

One may also mention patents E12706936/EP2678633/ES2540573T3, which disclose an explosive detonator system for detonating a charge of explosive whereby, during use, arranged in a detonation relation, the detonator system comprising a detonator, which includes a detonator capsule; a detonation circuit within the detonator capsule, including the detonation circuit comprising a conductive path; an igniter head within the detonator capsule, the igniter head comprising at least two spatially separated conductive electrodes and a resistive bridge connecting the space between the electrodes, integrating the igniter head with the detonation circuit such that the conductive path passes along both the electrodes and the resistive bridge; included in a charge signal communicated to the detonator during use, such that exposure to the charge property charges the voltage source, thereby rendering the voltage source capable of causing a potential difference between the electrodes at least to equal the breakdown voltage of the resistive bridge; and a shock tube which is provided, during use, in close proximity of initiation to the detonator and is capable of providing a shock signal as at least part of the charge signal, the shock tube comprising a hollow elongated body, within which is provided a shock tube explosive, whose detonation provides the shock signal, wherein the charging property includes at least a charging light pulse and, optionally, a charging temperature, a charging pressure and/or a charging radio frequency of the charging signal, making the chargeable voltage source therefore sensitive to the charging light pulse and, optionally, to either the charging temperature, the charging pressure and the charging radio frequency, or their conjunction; and whereby a photoluminescent chemical is provided within the hollow elongated body supplying the charging light pulse.

On the other hand, patent U.S. Pat. No. 6,173,651 B1 discloses a detonator control method equipped with an electronic ignition module. Each module is associated with specific parameters including at least one identification parameter and a burst delay time, and includes a trigger capacitor and a rudimentary internal clock. The modules can communicate with a trigger control unit equipped with a reference time base. Identification parameters are stored in the modules via a programming unit; specific parameters are stored in the trigger control unit; for each successive module, their internal clock is calibrated by the trigger control unit and the associated delay time is sent to the module; the modules are commanded to charge the trigger capacitors and a trigger command is sent to the modules via the trigger control unit, which triggers an eventual reset of the internal clocks as well as a trigger sequence.

A second US patent, U.S. Pat. No. 4,674,047 A1 discloses a detonation system for use with electric power supply that has a user-operable firing console for selectively transmitting unit identification information, firing delay time information, and selections from a set of commands including Exit, Delay, Fire (Time), Abort, Power On (Arm), Entry, and Store.

The console displays the responses or digested information from the responses of the electrical delay triggers to the commands. Detonators have an explosive, a capacitor to store energy from the supply to activate the explosive, a circuit to charge the capacitor from the supply and transfer energy from the capacitor to the explosive in response to first and second signals caused by the commands. Each detonator can be programmed with a unique identification number and delay time. The time base for each detonator can be compensated, avoiding time base errors preventing a correct delay. The security code circuits and software are described in such a way that each detonator can only be activated by authorized users.

However, their use has not been without problems; the vibration caused by the explosives restricts their use in urban areas and damages the environment, causing the risk of scour and forcing the company to incur the cost of repairing the surrounding geology. On the other hand, in commercial mining operations, the conventional explosive fragmentation method results in a jumbled mixture of inert material with the ore, which must be removed from the mine, crushed and processed; this, added to the depletion and lowering of ore grades worldwide, has implied an increase in tailings removal, and the way in which this is treated is key, where stages such as fragmentation can affect a company's productivity and profitability. The importance of the concept of controlled fragmentation in mining transpires from this.

The use of alternative fast expanding metallic mixtures, which do not contain dynamite, dates from after World War II, and the technological advances are mainly reflected in the Korean patent No. 10-0213577, consisting of a fast expanding metallic mixture with ignition points up to 700° C., with applications in the mining and civil works industry and whose main characteristic is a higher and shorter (time) expansion force when compared to dynamite.

The fast-expanding metallic mixture corresponds to a chemical mixture composed of metal salts and powders, available in multiple formulations on the market, according to the following examples:

| | |
|---|---|
| $2Fe(NO_3)_2+12Mn$ | Formula 1; Patent No. 10-0213577 |
| $Fe(NO_3)_2+3CuO+6Al$ | Formula 2; Patent No. 10-0213577 |
| $3Ca(NO_3)_2+Fe_3O_4+12Al$ | Formula 3; Patent No. 10-0213577 |
| $Fe_2O_3+4Na_2O+BaCO_3+4Mg$ | Formula 4; Patent No. 10-0213577 |
| $Fe_2O_3+NaSO_4+4Al$ | Formula 5; Patent No. 10-0213577 |
| $2Na_2O+Fe_2O_3+3CuO+2Al$ | Formula 6; Patent No. 10-0213577 |
| $2NaClO_4+2CuO+2Al$ | Formula 7; Patent No. 10-0213577 |

A formula, as identified in Formula 1 above, subjected to temperatures of 1,500° C., (Note that the ignition temperature varies according to the ratios of salt and metal powder mixture in each Formula), triggers the following thermochemical reaction of its components:

$$2Fe(NO_3)_3+12Mn \rightarrow 2FeO+4Mn_3O_4+3N_2$$

The metal salt allows the oxidation of the metal powder, the heat generated in the oxidation process of extremely high temperatures (3,000° C.-30,000° C.) is caused instantaneously, releasing a large amount of thermal energy, converting the iron (Fe) and manganese oxide ($Mn_3O_4$) products into vaporized gases that expand rapidly; the expanded product by vaporization is changed to a solid state, thus stopping the expansion reaction. When the outcome occurs in a confined space, the release of expansive energy is what finally allows the rock to fracture due to the high pressures reached (5,000-20,000 Atm).

As in the formula stated above (Formula 1), metal nitrates are the most preferable; however, a rapidly expanding metal mixture can also be composed of other metal salts such as: metal oxides, metal hydroxides, metal carbonates, metal sulfates and metal perchlorates. This metallic salt can be used on its own or combined with others. In particular, metal nitrates can be further added with at least one metal salt selected from metal oxides, metal hydroxides, sulfates and metal perchlorates, to control the temperature required for the onset of oxidation and the period of time required for oxidation.

As in the formula noted above (Formula 1), the metal powder is preferably selected from the group consisting of aluminum powder (Al), sodium powder (Na), potassium powder (K), lithium powder (Li), magnesium powder (Mg), calcium powder (Ca), Manganese powder (Mn), Barium powder (Ba), Chromium powder (Cr), silicon powder (Si) and combinations thereof.

The proportions used to compose the mixture of metallic salts and powdered metal are defined according to the ratio of amounts of oxygen caused by the metallic salts and the amounts of oxygen required to oxidize the powdered metal. This ratio of generation versus requirement provides a ratio based on molecular weights calculated from chemical formulas.

The composition, function, and preparation process of a rapidly expanding metallic mixture is not part of the subject matter of this paper. There are various public domain documents or patents with this information.

The high temperature condition required to trigger the oxidation reaction of a rapidly expanding metal mixture can be achieved through various methods. However, one of the most widely used methods today consists of that described in patent EP 1 306 642 B1, in which a capsule structure is provided for a rapidly expanding metallic mixture, in which high-voltage arc discharge heat (causing temperatures of thousands of degrees), is used as the heat source.

As described in patent EP 1 306 642 B1, the capsule for a rapidly expanding metallic mixture comprises an outer casing made of an insulating material, with the rapidly expanding mixture contained in the outer casing, and two power supply rods extending outwardly from both ends of the outer casing. Two main firing electrodes are provided to induce arc discharge at the inner ends of the two power supply rods. The two main firing electrodes induce an arc discharge between them when high voltage is applied to them. When a high voltage of 2 kV or more is applied to the two feed rods, an arc discharge is induced between two trigger electrodes, instantly causing a high temperature of approximately 2,000° C. or more at the positions around the positive and negative trigger electrodes. The voltage requirement varies according to the distance of the electrodes, namely, when the firing electrodes are spaced at intervals of 200 mm or more, a voltage of 6-7 kV or more needs to be applied to the trigger electrodes to induce an effective arc discharge between the electrodes. Nevertheless, in the case of activating trigger electrodes spaced at intervals of 100 mm or less, an equally effective arc discharge between the electrodes is induced, even with the use of a voltage of 3-4 kV. It is understood that the voltage level has a slight variation depending on other conditions, such as type of resistance wires, as well as types and concentrations of electrolytes.

The disadvantages of this method lie mainly in the high voltage requirement necessary to achieve the high temperature that triggers the chemical reaction and the lack of a testing system to reduce or eliminate the existence of non-activated capsules.

The use of patent EP 1 306 642 B1 could be reduced in projects requiring a large volume of non-explosive fragmentation, because the high voltage required for the activation of the necessary chemical reaction would be a limiting factor for the number of capsules in the field. For example, if 10 boreholes are required in a given project, using the system of patent EP 1 306 642 B1, it would be necessary to connect 10 initiators in series; since the voltage requirement to activate the chemical reaction is 2 kV per capsule, the generator equipment must supply the system with 20 kV.

SUMMARY

This development aims to provide a non-explosive (deflagrating) programmable electronic initiator for a rapidly expanding metallic mixture (such as plasma and/or explosives of different category), which seeks to provide a solution to the above technical problems in rock fragmentation; to achieve the high temperature necessary to activate a rapidly expanding metallic mixture with a very low voltage requirement; to improve the rates of non-activated charges (left behind firings) with an effective test system; to provide work continuity, increase productivity and safety in the processes related to rock fragmentation with a programmed delay system in each initiator.

This development is related to a non-explosive programmable electronic initiator, whose purpose is to activate the chemical reaction of a rapidly expanding metallic mixture with a temperature higher than 1,000° C.; whose main characteristics are: a low voltage requirement (less than 35 V), which allows a large number of capsules in the mesh to be fragmented (more than 400 capsules); a delay system (from 1 to 64,000 milliseconds), which allows greater precision and control of the fragmentation; a testing system that allows validation of the circuit prior to ignition, which eliminates the existence of non-activated capsules.

These differentiating characteristics individually and jointly improve the industrial applicability of a rapidly expanding metallic mixture in non-explosive rock fragmentation, significantly increasing production (fragmented $m^3$), safety and control with a minimum energy requirement.

By way of summary, the technical problems that the present development aims to solve are based on delay, voltage, temperature, and multi-testing.

In general, fast-expanding metallic mixtures, unlike other similar products, do not have any explosive components. However, its use allows obtaining similar results and with important advantages such as a significant reduction of handling and transportation risks, due to the great stability of the chemical mixture against shocks, friction, pressure and high temperatures; significant reduction of risks of work accidents; operational continuity due to the fact that the evacuation of people and equipment is minimal in a radius close to the blasting area; lower environmental impact due to the minimum levels of vibration, noise, shrapnel and no toxic gases.

However, their use has been limited by some features of the current patents available on the market, which are outlined below:

a. Delay

A technical problem with rock blasting is its effect on the rock in the vicinity, as it can produce intense fragmentation and disruption of the integrity of the rock in the surrounding area if the blasting or drilling systems are incorrect. One of the measures used to minimize the environmental impact caused by high vibrations and improve the safety of field work is the time delay in blasting.

In this development, each initiator has a programmable delay system, which allows to program in advance and individually the required delay period according to the blasting schedule. Each Non-Explosive Programmable Electronic Initiator [07] can be programmed with a delay time in the range of 1 millisecond to 64,000 milliseconds.

In the case of patent EP 1 306 642 B1, another initiator of rapidly expanding metallic mixtures, the lack of delay time is observed.

Some electronic initiators for explosives have a programmable delay time, which is the case of patent U.S. Pat. No. 6,173,651 (14,000 milliseconds, patent EP 1105693 B1, WO 0009967 A1 (according to patent 3,000 milliseconds, however, according to data sheet 30,000 milliseconds) whose initiators have the longest delay time known to date.

Another characteristic of a longer delay time would be the increase in productivity, since a greater number of drillings could be carried out for a more extensive blasting, maintaining a safe level with respect to vibrations and without having to re-equip the work area and reducing the workers' exposure to risk.

b. Voltage

In accordance with the provisions of the Regulation on High-Current Electrical Systems in Chile, high-voltage, high-current electrical systems or systems with rated voltages above 1,000V with a maximum of 220,000V are considered high voltage electrical systems and require a series of safety measures, while low voltage systems include systems or installations with rated voltages of between 100V and 1,000V. Understand the direct effect of this point on occupational safety and the potential effect of any accident related to the life and health of the workers involved.

A key feature of the present development is to deliver the voltage necessary to activate a single (or more than one) Programmable Non-Explosive Electronic Initiator [07] for a rapidly expanding metallic mixture. A voltage between 24V and 35V is required to activate the Programmable Non-Explosive Electronic Initiator [07]. The same voltage is required to activate one hundred (100) or more units of Non-Explosive Programmable Electronic Initiator(s) [07]: 24V and 35V. The voltage requirement does not vary either by distance between activation electrodes or by electronic initiator units arranged in the line.

This is because the connection of each Programmable Non-Explosive Electronic Initiator [07] to the line is in parallel.

In patent EP 1 306 642 B1, which considers an initiator for the activation of a rapidly expanding metallic mixture, each initiator requires 2,000V or more. Similarly, this patent points out different voltage requirements according to the distance between the activation electrodes: when the activation electrodes are separated by 200 mm or more, the voltage requirement for activation is between 6,000V and 7,000V; when the activation electrodes are separated by 100 mm or more, the voltage requirement for activation is between 3,000V and 4,000V. Because the connection of the initiators to the line is in series, the applied voltage is divided by the number of initiators on the line, so the voltage requirement of each initiator arranged in a blast increases the total voltage requirement.

In a concrete example, if 100 initiators were required to be used on a site, it is estimated that 200,000V (or more) would be required for initiators of the type proposed in patent EP 1 306 642 B1 to activate all the initiators. This requirement is impractical both in the mining industry and in civil works. If the same site were to use the Programmable Non-Explosive Electronic Initiators [07]proposed in this development, the total voltage requirement would be between 24V to 35V.

In other cases, the use of pyrotechnic drops or explosive tallow has been a solution to avoid the high voltage requirement, even if this means losing several of the qualities of the rapidly expanding metallic mixture, such as: reduced handling and transportation risks, reduced risk of occupational accidents, and operational continuity.

Other initiators such as, U.S. Pat. No. 5,171,935 A, CA 2 339 167 C, U.S. Pat. No. 8,746,144 B2, use a low voltage, however, they do not seek to reach a high temperature, a basic requirement for activation of the rapidly expanding metallic mixture.

c. Temperature

The voltage factor is also related to the high temperature condition required to trigger the oxidation reaction of a rapidly expanding metal mixture, as this can be achieved by various methods. In patent EP 1 306 642 B1, the high temperatures required (700° C. or more) for activation of the rapidly expanding metallic mixture is achieved by the high temperatures (thousands of degrees) caused by the electric arc from the high voltaic discharge; it is so large that it spares the existing filament in some instances.

In this development, the required high temperature (1,000° C. or more) is reached through the controlled discharge of Capacitor C7 [08] on the filament [12], leading it to glow for as long as needed, reaching the required temperature to activate the first rapidly expanding metallic mixture [13], which serves as a non-explosive tallow. Once the rapidly expanding metallic mixture [13] is activated, the necessary temperature (1,200° C. or more) is reached to activate the second rapidly expanding metallic mixture [15].

The higher temperature requirement (1,000° C.) for activating a rapidly expanding metallic mixture [13] in Programmable Non-Explosive Electronic Initiators [07] has a direct positive impact in terms of safety, both in terms of handling and transport.

d. Multi-Test System

It should also be noted that one of the key precautions to be taken in blasting, once the shot has been fired, is to examine the intervened area for the presence of non-activated initiators (misfire). An uncontrolled explosion could seriously endanger the integrity of the workers, so a team prepared for this purpose must guard the site and eliminate these shots, following the instructions established in the specific site's work procedures. Such is the seriousness of non-activated initiators (misfire), which are regulated by law in some countries.

The process requires, among other things, the presence of a supervisor during the entire operation, ensuring that the compromised area is cleared, removing unrelated workers and equipment, and using the minimum personnel necessary for this activity, thus reducing the number of people exposed to highly critical conditions.

This development involves a test system that avoids non-activated initiators (misfire) from taking place once the blasting is finished, reducing the labor risk in the field, allowing a safe execution and improving compliance with the blasting program.

By means of multiple internal diagnostics, the Programmable Non-Explosive Electronic Initiators [07] of the present development warn of specific errors:

- Communication failure between the Command Equipment [01] and the Programmable Electronic Non-Explosive Initiator(s) [07].
- Failure in the initial charge of Capacitor C7 [08].
- Failure in the final charge of Capacitor C7 [08].
- Filament continuity failure.
- Failure in the delay time value programmed in the EEPROM memory of Microprocessor IC1 [28].
- Failure in the system frequency change.

With the respective software diagnostics, the necessary information is obtained, ensuring the correct operation of the Programmable Non-Explosive Electronic Initiator(s) [07].

In the case of patent EP 1 306 642 B1, another initiator of rapidly expanding metallic mixtures, the lack of a test system may be observed.

Other patents such as WO 0009967 may include a test system focused on their needs; however, such systems lack a verification of the system's frequency shift.

The frequency change verification becomes essential to ensure the correct state prior to the activation of the "sleep" functionality of Microprocessor IC1 [28], which is directly related to the low voltage requirement and the achievement of the maximum delay time of 64,000 milliseconds.

Given all of the above, this development proposes advances that would allow the safe and productive, widespread use of the rapidly expanding metallic mixture.

DETAILED DESCRIPTION

Operating the Development

Figure 1B:
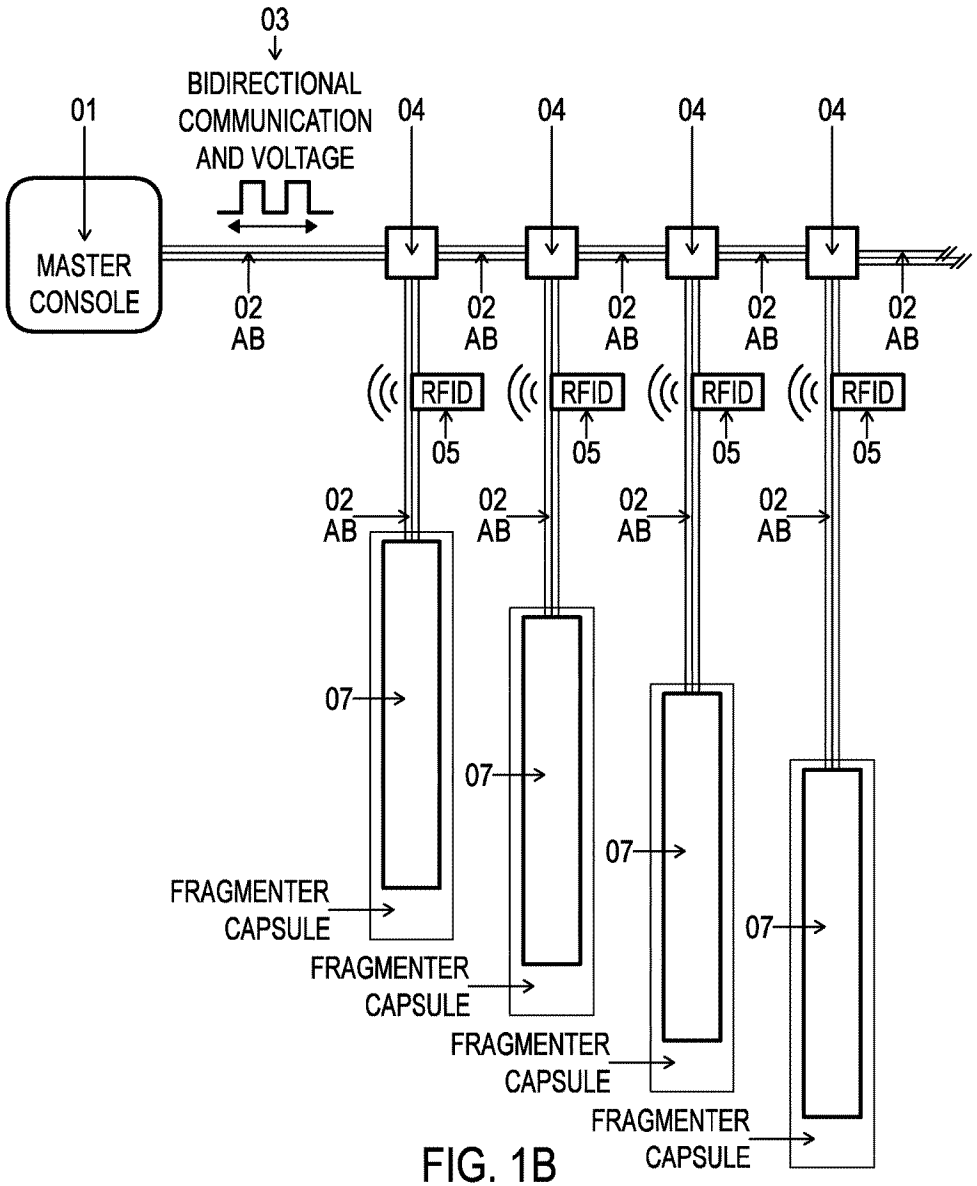
FIG. 1B depicts the present system using a single parallel Communication and Power line for four or more Programmable Non-Explosive Electronic Initiators.

It must be stated that this development is not limited to the particular methodology, compounds, materials, manufacturing techniques, uses, and applications described herein, as these may vary. It should also be understood that the terminology employed herein is used for the sole purpose of describing a particular embodiment, and is not intended to limit the perspective and potential of this invention.

It should be noted that in the use and method, here, in the statement of claims and throughout the text, the singular does not exclude the plural, unless the context clearly implies so. So, for example, the reference to a "use or method" is a reference to one or more uses or methods and includes equivalents known to those familiar with the subject matter (the art). Similarly, as a further example, the reference to "a step", "a stage" or "a mode" is a reference to one or more steps, stages, or modes and may include implied and/or upcoming sub-steps, stages, or modes.

All conjunctions used should be understood in the least restrictive and most inclusive sense possible. Thus, for example, the conjunction "or" should be understood in its orthodox logical sense, and not as an "or excluding", unless the context or the text expressly requires or indicates it. The structures, materials, and/or elements described must be understood to also refer to those functionally equivalent in order to avoid endless, exhaustive enumerations.

Expressions used to indicate approximations or conceptualizations should be understood as such, unless the context dictates a different interpretation.

All technical and/or scientific names and terms used herein have the common meaning given to them by an ordinary person qualified in these matters, unless expressly indicated otherwise.

Methods, techniques, elements, compounds, and compositions are described, although similar and/or equivalent methods, techniques, compounds, and compositions to those described may be used or preferred in practice and/or when testing this invention.

All patents and other publications are incorporated as references, for the purpose of describing and/or reporting, for example, methodologies described in such publications, which may be useful in connection with this invention.

These publications are included only for the information they contain prior to the filing date of this patent application.

Nothing in this regard should be considered an admission or acceptance, rejection or exclusion, of the entitlement of the authors/inventors to be considered as such, or of such publications being backdated pursuant to previous ones, or for any other reason.

In order to provide clarity to the present development, the following concepts will be defined:

- Delay: The concept of delay or delay time in the present development refers to the assignment of a countdown delay period measured in milliseconds (ms) that determines the firing sequence in a blast. Each detonator is assigned a previously defined time period (between 1 and 64,000 milliseconds).
- Misfires: The concept of misfires for the present development refers to the complete or partial misfire of one (or more) capsule comprised in the firing sequence in a blast. It is a high-risk unintended consequence, in which product debris that can be activated by any mechanical effect during the excavation, milling or crushing stages of the mining process.
- Microprocessor: The concept of microprocessor used for the present development refers to the set of integrated electronic circuits that carry out the instructions and tasks involved in information processing. The present development requires a Microprocessor with the following features: serial communication, low power consumption (preferably but not restricted to 20 nA in sleep mode), precision internal oscillator (preferably but not restricted to 31 KHz to 32 MHz), feasibility of integrating an external low frequency oscillator (preferably but not restricted to 32 KHz), memory capacity (preferably but not restricted to EEPROM 256 bytes, SRAM 256 bytes) and sufficient input and output ports to perform the functions required (at least 8). Microchip model PIC16LF1824/1828 has been identified as a feasible Microprocessor for executing the commands and programs required in this development.
- Communication protocol: a system of rules that allow two or more entities of a communication system to communicate with each other and transmit information. This development refers to the form of bidirectional communication between the Command Equipment [01] and the Non-Explosive Electronic Initiator(s) [07] that maintains the transmission of information and the voltage necessary for the operation of the Non-Explosive Electronic Initiator(s) [07], and which may take place under the bit per second transmission language through voltage pulses.
- Filament: In the present development, the filament has a thickness, length and materiality that achieves a balance between capacitance and resistance to avoid it from being cut and achieving the necessary temperature. By way of example and without restricting the scope of this term, this could refer to a tungsten filament of a purity varying between 99.90% and 99.99%, preferably 99.93%, 99.95% and 99.97%, in spiral form with a length varying between 1 and 3 mm, preferably 2 mm, 2.2 mm, 2.5 mm, with a diameter of a range between 0.01 mm and 0.1 mm, preferably 0.01 mm, 0.02 mm, 0.03 mm and with a resistance ranging from 2.5 to 4.5 ohm, preferably 3 ohm, 3.2 ohm, 3.5 ohm, 3.6 ohm, 3.7 ohm, 3.8 ohm and 3.9 ohm.

Safety: The development addresses the precautions to be taken with the different devices, based on their manipulation and how to maintain the inactivation of the initiator through special commands created for such purpose.

Exothermic reaction: This development refers to any chemical reaction that gives off energy, either as light or heat, or, in other words, with a negative enthalpy variation.

Plasma: In the present development, plasma is considered as a rapidly expanding mixture of metallic salts that upon initiation produces a high-temperature exothermic reaction in a confined space. It is a very stable substance, as it does not react to high temperatures, shocks, friction, and high pressures. The reaction is initiated at high temperatures, above 1,000° C.

In order to operate the present development, a Command Equipment (Console or Master) [01], with the capacity to convert the serial communication into a communication protocol based on Voltage Modulation [03] through a Communication and Power Line (parallel lines) [02A and 02B], a connector [04] that connects said parallel lines with the Non Explosive Programmable Electronic Initiator(s) [07] (FIGS. 11A and 11B) and a REID Card Reader (Logger) [06] are required.

Other general requirements for the operation of the Command Equipment [01] consist of, but are not limited to: external power supply (preferably 24V to 36V battery), microprocessor, Micro SD card, Bluetooth system, REID reader [06], wireless transmission and display with keypad.

The operation of the development also requires a Communication and Power Line [02A and 02B] consisting of two parallel copper wires, each with a diameter greater than 0.5 millimeters, and a resistance of less than 36 ohm per kilometer. These cables play an essential role, and when used according to the instructions in Table I, they ensure both the reliability in the transmission of Voltage Modulation [03] and communication protocol (FIG. 2), as well as the power received by each Programmable Non-Explosive Electronic Initiator [07].

TABLE I

Electrical Conductor Resistance
Maximum Copper Wire Resistance ohm/km at 20 C.

| | Mono or Multipair | |
|---|---|---|
| Diameter | Cu (uncoated) ohm | Cu (coated) ohm |
| 0.5 | 36.00 | 36.70 |
| 0.75 | 24.50 | 24.80 |
| 1 | 18.10 | 18.20 |
| 1.5 | 12.10 | 12.20 |
| 2.5 | 7.41 | 7.56 |
| 4 | 4.61 | 4.70 |
| 6 | 3.08 | 3.11 |
| 10 | 1.83 | 1.84 |

For this development to have a practical use (in the field), it should consider the use of a portion of two rapidly expanding metallic mixtures [13] and [15] (PLASMA) with a formulation similar to the ones mentioned earlier, such as:

| | |
|---|---|
| $2Fe(NO_3)_2+12Mn$ | Formula 1; Patent No. 10-0213577 |
| $Fe(NO_3)_2+3CuO+6Al$ | Formula 2; Patent No. 10-0213577 |
| $3Ca(NO_3)_2+Fe_3O_4+12Al$ | Formula 3; Patent No. 10-0213577 |
| $Fe_2O_3+4Na_2O+BaCO_3+4Mg$ | Formula 4; Patent No. 10-0213577 |
| $Fe_2O_3+NaSO_4+4Al$ | Formula 5; Patent No. 10-0213577 |
| $2Na_2O+Fe_2O_3+3CuO+2Al$ | Formula 6; Patent No. 10-0213577 |
| $2NaClO_4+2CuO+2Al$ | Formula 7; Patent No. 10-0213577 |

It should be understood that, for the use of the present development, the rapidly expanding metal mixtures [13] and [15] will be activated and the expected exothermic reaction will be triggered.

Development Overview

The present development consists of a Programmable Non-Explosive Electronic Initiator [07], comprising a capsule with two types of rapidly expanding metallic mixture [13] and [15] that allows coupling to a container tube or sleeve [16] and a sealing plug [17] (FIG. 3); and that, once it receives the Voltage Modulation [03] and the communication protocol (FIG. 2), by means of commands, the functions that allow reaching the high temperatures required to initiate the chemical reaction are activated, using a low voltage requirement (less than 35V), with a delay system (from 1 ms to 64,000 ms), and with a testing system that allows validation of the circuit prior to ignition.

An algorithm is programmed and saved in Microprocessor IC1 [28] in order to give functionality to the system. By means of functions and commands, this algorithm recognizes from the input signal, reads input data concerning the oscillator frequency (FIG. 4), reads data from the filament and capacitor sensors (FIG. 4) [28C], activates the ports (FIG. 4) [28B] of capacitor charging, triggering, capacitor discharging, activation of the serial communication port (FIG. 4) [28E], for sending data through the Communication and Power Line [02A and 02B] to the Command Unit [01], receiving the data through Interrupt (FIG. 4) [28D], and the CPU central processing unit (FIG. 4) [28F], which performs the task of processing all the functions as well as storing the information.

Each Non-Explosive Programmable Electronic Initiator [07] has a unique and unrepeatable identification (ID), which is recorded at the factory and matches the internal code of the external RFID card [05]. By means of an algorithm, the Command Equipment [01] captures this ID through the serial port via Bluetooth through the RFID reader equipment (Logger) [06] (FIG. 1) and stores it in the MicroSD card belonging to the Command Equipment [01]. The data are available for further use in certain processes.

Figure 4:
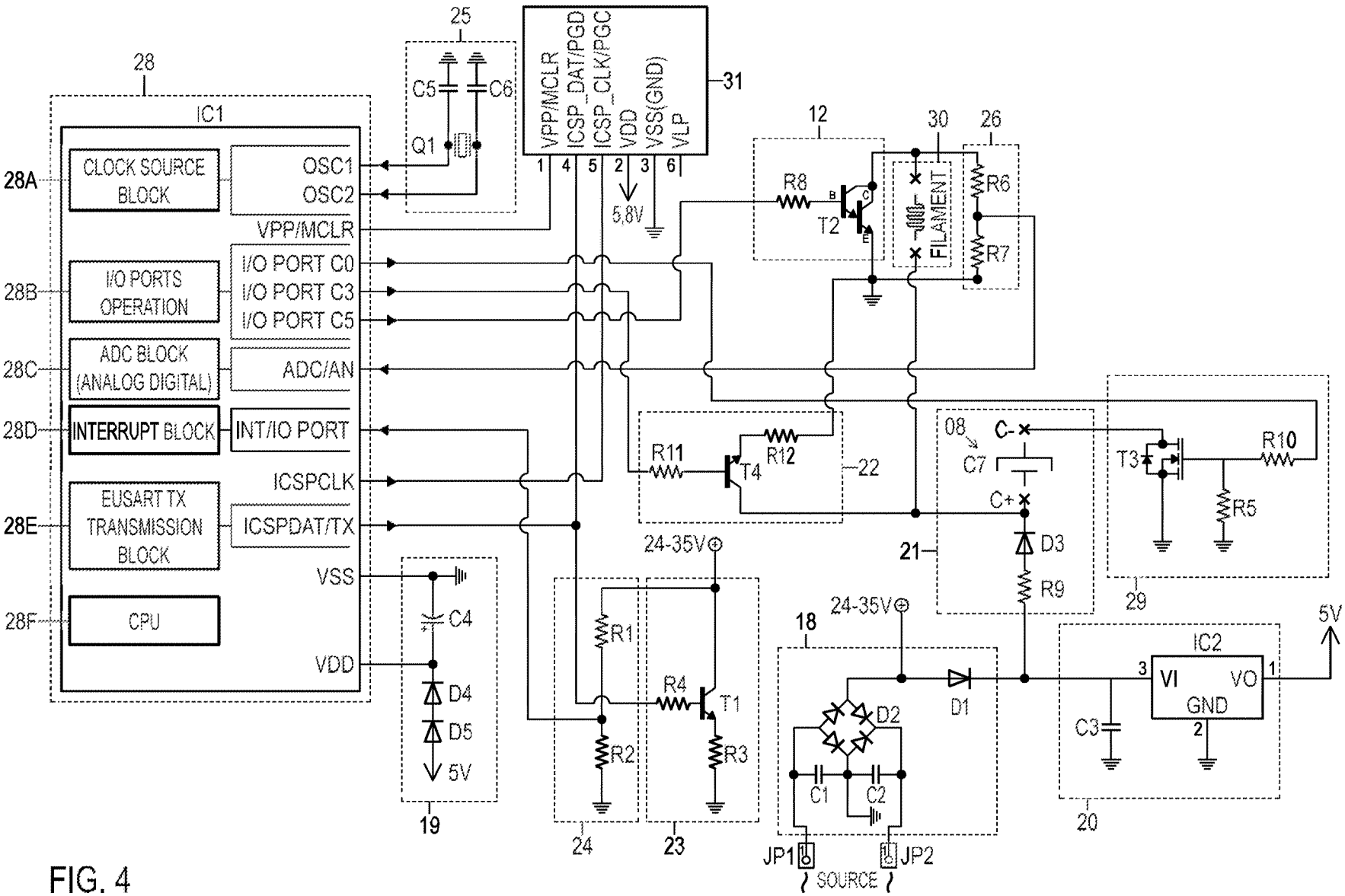
FIG. 4 is a schematic circuit of a Programmable Non-Explosive Electronic Initiator of the present disclosure.
Figure 5:
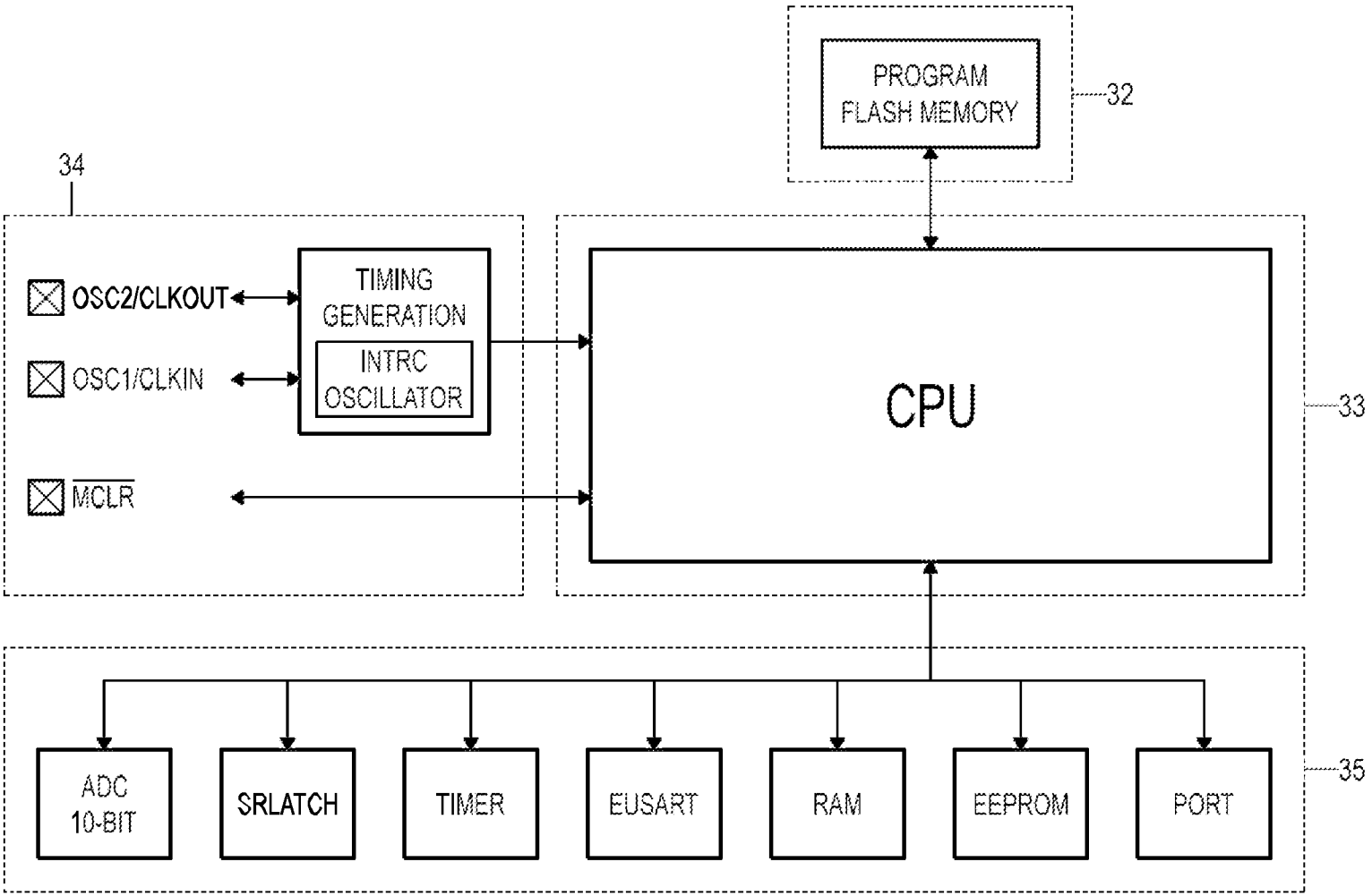
FIG. 5 is a specification of the CPU programming and feedback described in the schematic circuit of the Programmable Non-Explosive Electronic Initiator of FIG. 4.

The Programmable Non-Explosive Electronic Initiator [07], has a Microprocessor IC1 [28] (FIG. 4), with an Internal Oscillator and a non-volatile EEPROM memory [35](FIG. 5).

Figure 2A:
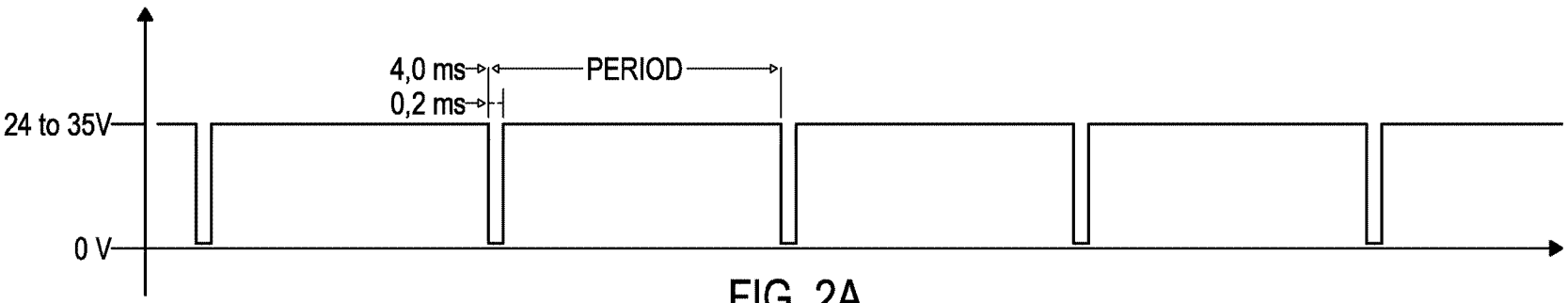
FIG. 2A is a diagram representing voltage waves showing the beginning of a bidirectional communication, where the Voltage Modulation sent consists of a constant square wave.

With the Command Equipment [01] activated, and all requirements for operation in order, the Communication and Power Line [02A and 02B] is activated, initiating the Voltage Modulation [03] and the communication protocol (FIG. 2) coming from the Command Equipment [01]. At the beginning of the bidirectional communication, the Voltage Modulation [03] (FIG. 2) sent consists of a constant square wave with a defined amplitude between 24V and 35V (FIG. 2A) and a period of 4.0 ms. The high bit of 4 milliseconds and the low bit of 0.2 milliseconds allow a constant voltage to be maintained (FIG. 2A).

It is to be understood that the abovementioned Voltage Modulation [03] (FIG. 2) is the one that allows to match the sending of data and energy necessary for the subsequent activation of one (or more) Programmable Non-Explosive Electronic Initiator [07].

A bidirectional communication protocol (FIGS. 2B and 2C) with a transmission rate of 2,400 bits per second is used in the Communication and Power Line [02A and 02B].

Figure 2B:
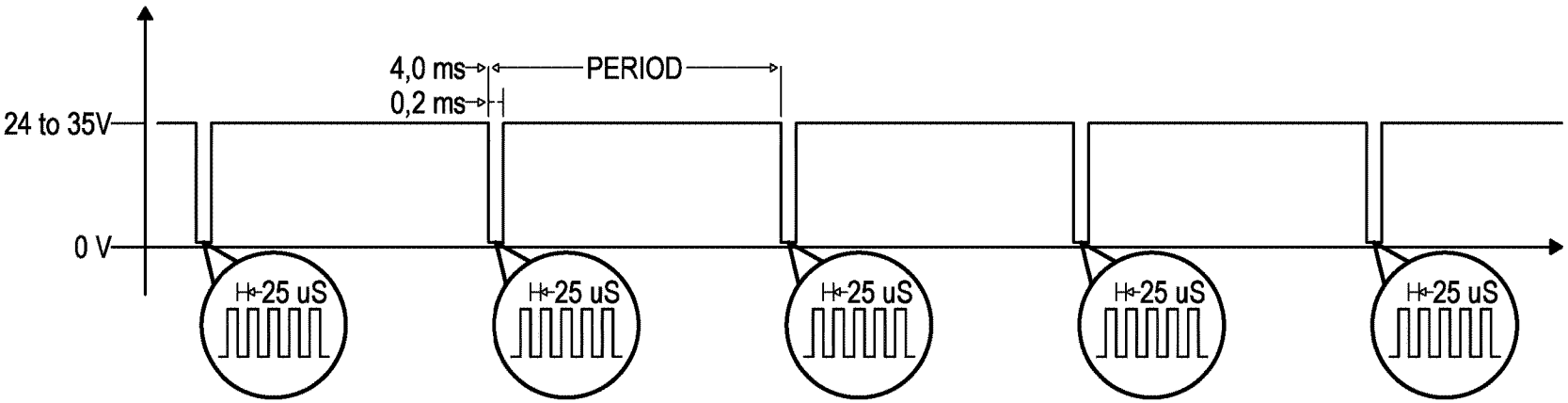
FIG. 2B is a first diagram representing voltage waves showing a bidirectional communication protocol with a transmission rate of 2,400 bits per second that is used in the Communication and Power Line.
Figure 2C:
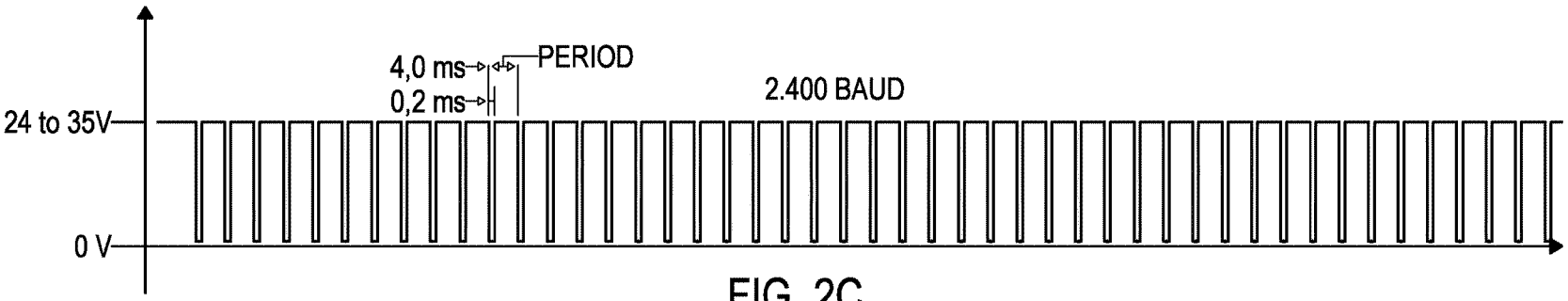
FIG. 2C is a second diagram representing voltage waves showing the bidirectional communication protocol with a transmission rate of 2,400 bits per second that is used in the Communication and Power Line.

Data is sent at a communication rate equivalent to 2400 baud from the Command Equipment [01] via the Communication and Power Line [02A and 02B] and is received by the Programmable Non-Explosive Electronic Initiator(s) [07] (FIG. 2C).

Data is sent over the Communication and Power Line [02A and 02B] from the Programmable Non-Explosive Electronic Initiator(s) [07] and received by the Command Equipment [01] (FIG. 2B). The sending of data from the Programmable Non-Explosive Electronic Initiator [07] to the Command Equipment [01] is determined by a 25 us (microsecond) bit, equivalent to 40,000 baud; data transmission (one byte) is performed on the low bit of the communication line.

The Programmable Non-Explosive Electronic Initiator input [07], comprises a diode D1 and a Voltage Rectifier D2 [18] (FIG. 4), which are connected to the Communication and Power Line [02A and 02B]. Diode D1 suppresses transient currents and prevents current leakage. The D2 Voltage Rectifier, with voltage inputs between 24V and 35V, transforms alternating current (AC) into direct current (DC) (FIG. 4).

A Voltage Regulator IC2 [20] receives the voltage from 24V to 35V and the rectified current (DC). This IC2 Voltage Regulator regulates the initial voltage to 5V (FIG. 4).

Figure 7:
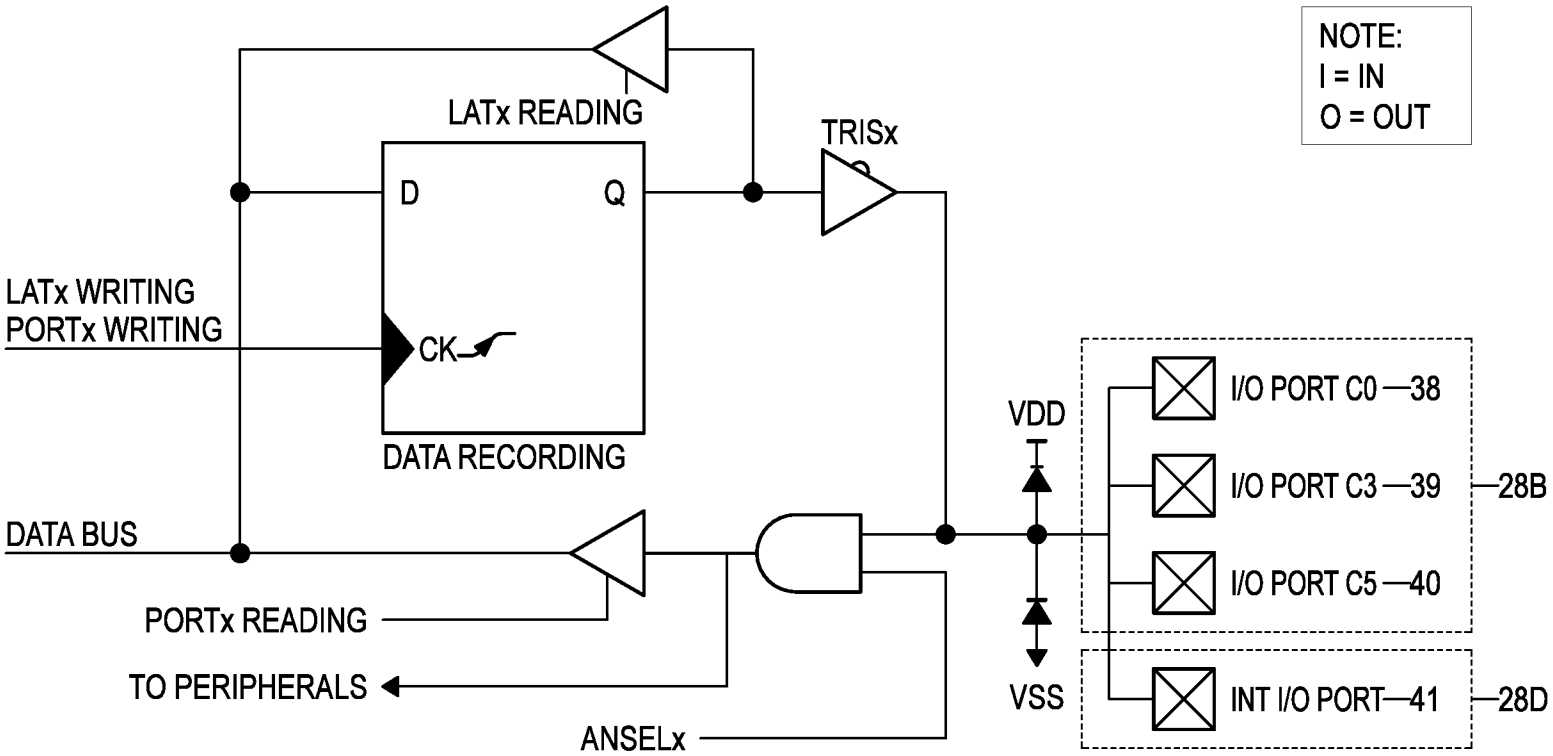
FIG. 7 is a diagram of how the square wave with the data is transmitted from the Command Unit to the INT/IO PORT input pin and IO output ports of FIG. 4.

For bidirectional communication between the Command Equipment [01] and the Programmable Non-Explosive Electronic Initiator [07], two voltage divider resistors R1 and R2 [24] are connected to the system input of the Programmable Non-Explosive Electronic Initiator [07], which lower the voltage from 24V-35V to 5V, thus adjusting to the operating level of the Microprocessor IC1 [28]. In addition, R1 operates with resistance between 90 and 170 kOhm, preferably 110 kOhm, preferably 120 kOhm and preferably 130 kOhm and R2 operates with resistance between 15 kOhm and 25 kOhm, preferably 110 kOhm, preferably 120 kOhm and preferably 130 kOhm. The square wave with the data is then transmitted from the Command Unit [01] to the INT/IO PORT input pin [41](FIG. 7) of the IC1 Microprocessor [28] and converted into bytes using an algorithm.

Figure 9:
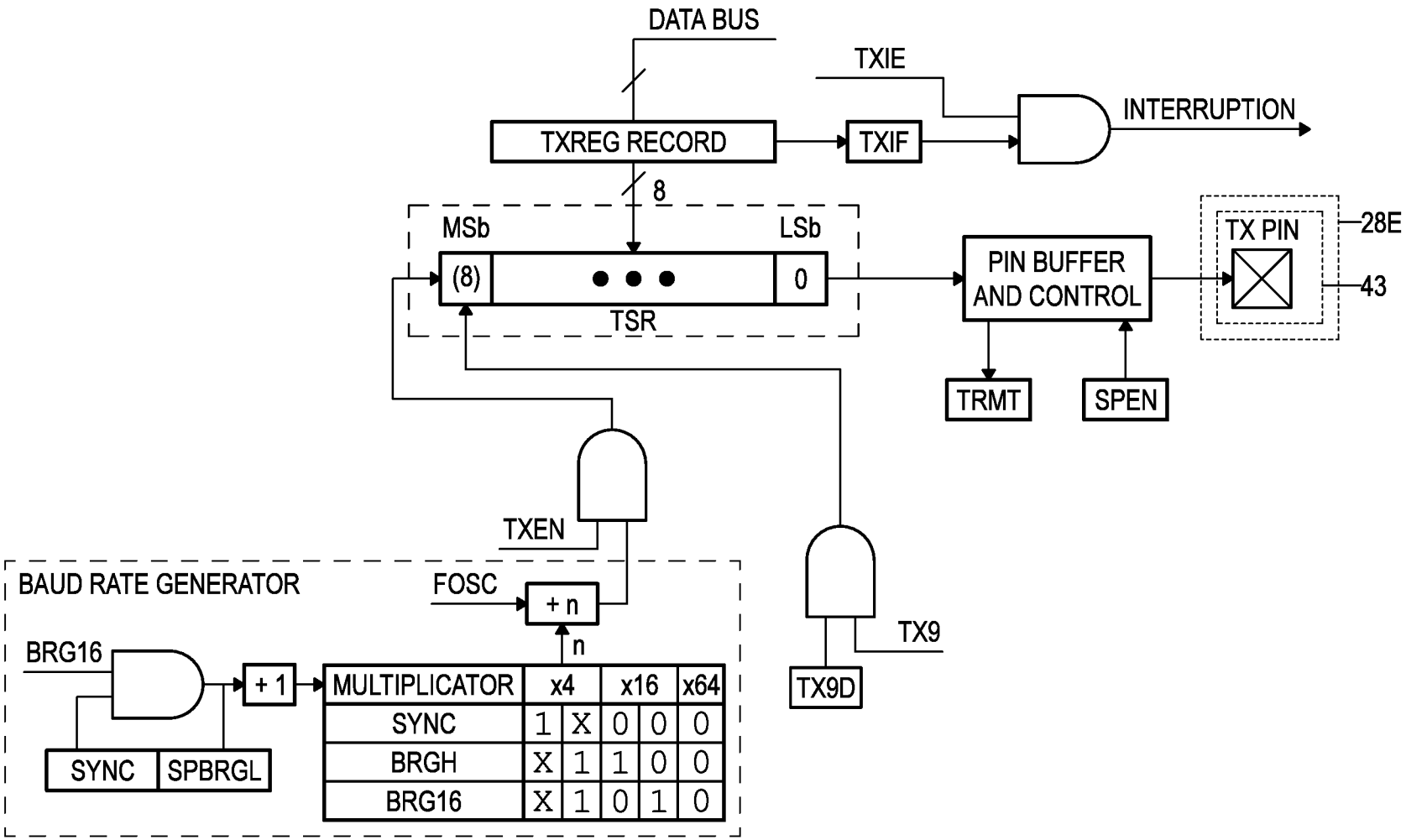
FIG. 9 is a diagram of how Microprocessor IC1 of FIG. 4, through the USART transmission block pin TX, transmits the output data.

In response, the Microprocessor IC1 [28] through the EUSART transmission block [28E] (FIG. 4) pin TX [43] (FIG. 9), transmits the output data. The output data are inserted through a transistor T1 and two resistors R3 and R4 [23] in the Communication and Power Line [02A and 02B]. The response data is then sent to the Command Team [01] for processing (FIG. 2B).

Two diodes D4 and D5 are connected to the 5V voltage input [19]. In this stage of the circuit, the input voltage 5V is reduced to 3.6V, which is necessary to operate the IC1 microprocessor [28]. Diodes D4 and D5 [19] suppress transient currents and prevent current leakage.

Figure 6:
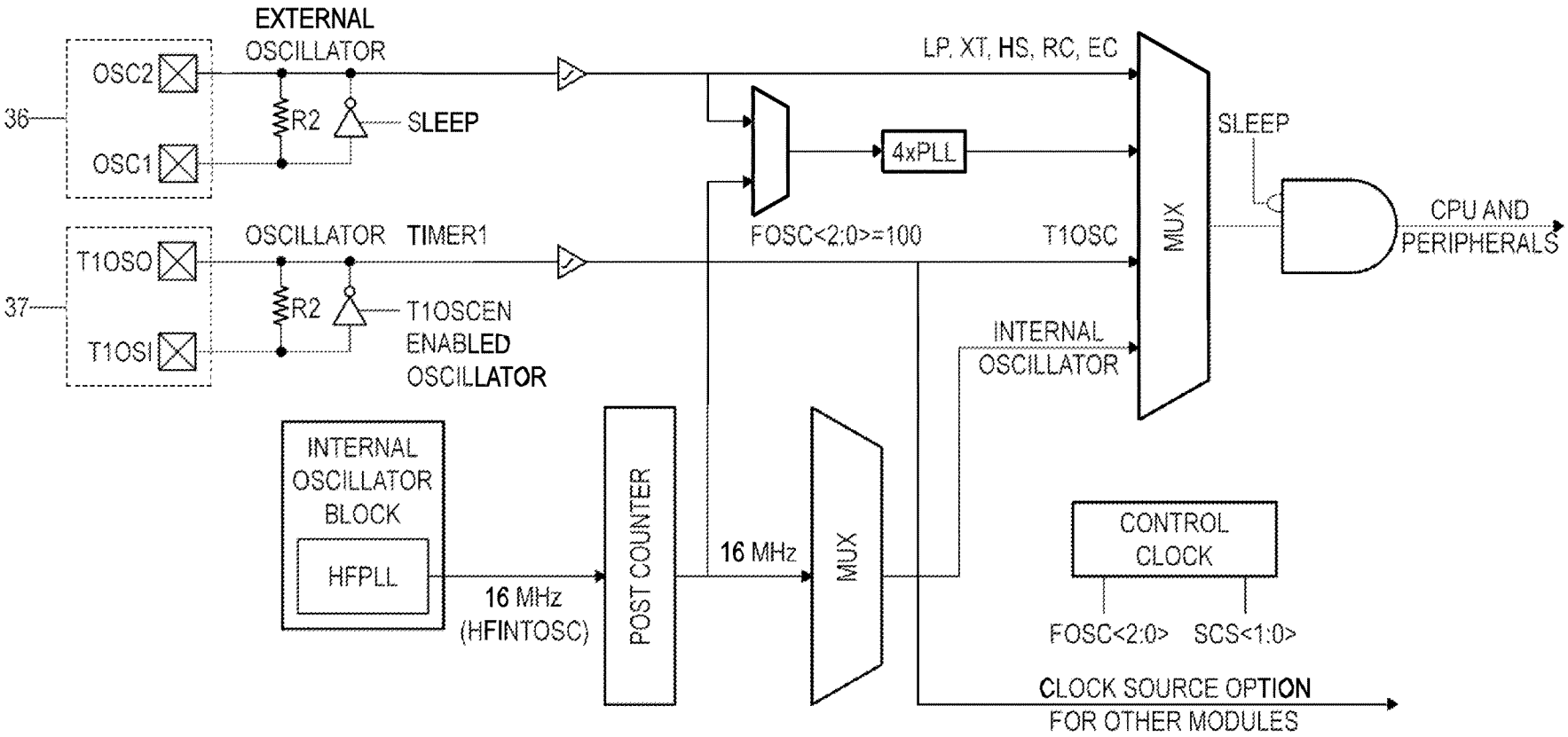
FIG. 6 is a detailed representation of the dynamics generated in a Clock Source Block of the present disclosure.

A 6.3V, 470 ρF Capacitor C4 [19], connected to diodes D4 and D5 [19] and to the voltage input of Microprocessor IC1 [28], keeps the 3.6V input voltage stable. Capacitor C4 [19] is an energy reservoir that is continuously charged. It is essential to note that this device will be the power source for Microprocessor IC1 [28] and will keep it active for up to 64,000 milliseconds, once the Communication and Power Line [02A and 02B] is interrupted. The discharge time of this capacitor must be greater than the programmed delay time; this point is addressed in more depth when describing the operation of the External Oscillator [25] (FIG. 4) and OSC [36] (FIG. 6).

Two resistors R6 and R7 [26] divide the voltage between Ground (GND), Filament [12] and Capacitor C7 [08] (FIGS. 3 and 4) of 35V. Filament [12] is a Tungsten spiral with a length ranging from 1 to 3 mm, preferably 2 mm, 2.2 mm, 2.5 mm, with a diameter ranging from 0.01 mm to 0.1 mm, preferably 0.01 mm, 0.02 mm, 0.03 mm and with a resistance ranging between 2.5 and 4.5 ohm, preferably 3 ohm, 3.2 ohm, 3.5 ohm, 3.6 ohm, 3.7 ohm, 3.8 ohm and 3.9 ohm.

As a safety measure, a transistor T4 [22] (FIG. 4) connected to a series resistor R12 (current limiter), which in turn is connected to ground (Vss or GND), maintains the Filament [12] and the Capacitor C7 [08] with a voltage lower than 1V. The Transistor T4 [22] is deactivated by issuing a command (Command 5) to start the charging process of Capacitor C7 [08], prior to firing. Once all the elements of the circuit have been activated, if any fault is detected, through a command (Command 6), this Transistor T4 [22] discharges to ground (Vss or GND) the Capacitor C7 [08], reducing the voltage of the Capacitor C7 [08] to a value lower than 1 V and preventing the Filament [12] from having the necessary voltage to ignite and activate the metallic fast-expansion mixture.

Filament [12] is connected to Capacitor C7 [08] (initial charge 0V) and transistor T2 [27]. Once the Trigger Command (Command 7) has been activated, the I/O PORT pin C5 [28B] (FIG. 4) activates the transistor T2 [27] to discharge the Capacitor C7 [21] in the Filament [12], causing it to glow.

Resistor R9 [21] limits the input current to a value ranging between 2 and 3 milliamps, this allows a slow charging of Capacitor C7 [08] and a minimum current consumption. Diode D3 [21] prevents current leakage from Capacitor C7 [08].

The resulting analog voltage between resistors R6 and R7 [26] (DC) enters the ADC/AN pin [28C] (FIG. 4). The analog information received by the Microprocessor IC1 [28] through the ADC/AN pin [42] (FIG. 8) is converted to digital for sensor readout.

The arrangement of the elements, together with the processes and commands activated by means of an algorithm, allow for establishing a Test System based on the values provided by the sensor configured on the ADC/AN pin [42] (FIG. 8) belonging to Microprocessor IC1 [28] (FIG. 4).

Figure 8:
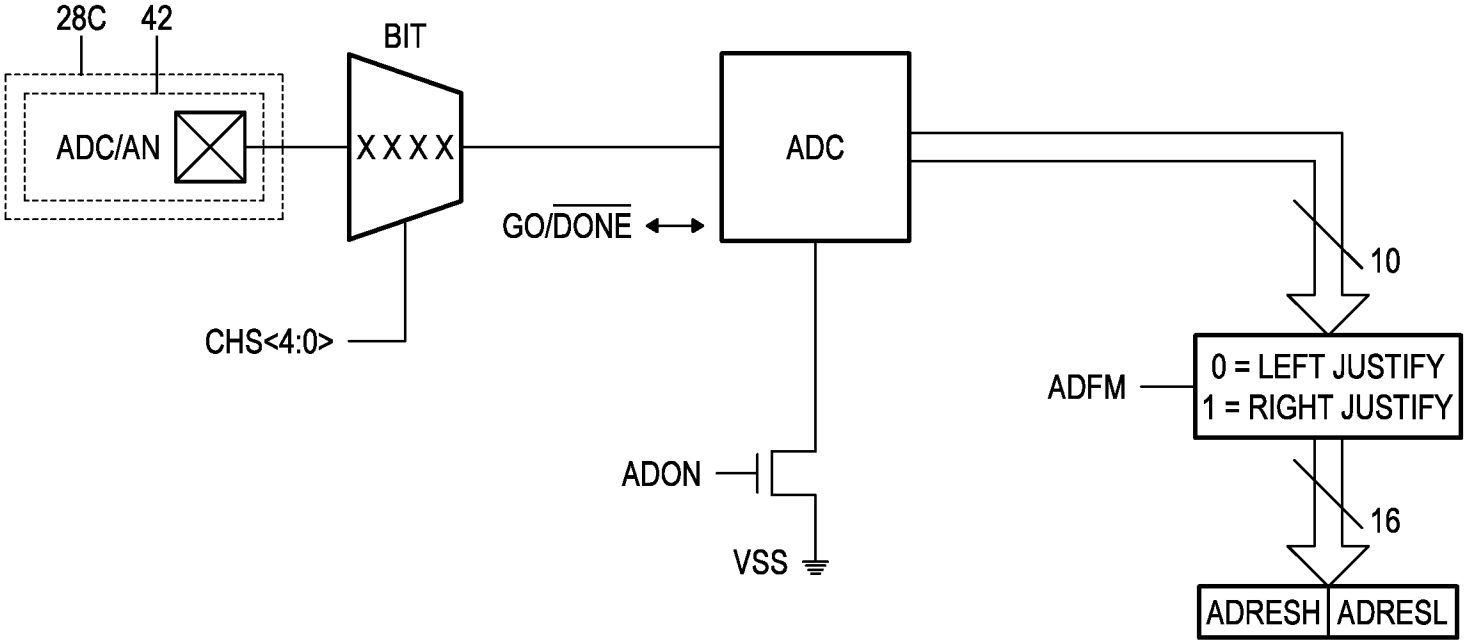
FIG. 8 is a diagram of the analog information received by the Microprocessor IC1 through the ADC/AN pin in FIG. 4.

The Test System is powered by the sensor data configured on the ADC/AN pin [42] (FIG. 8). The data obtained are analyzed by means of an internal algorithm of Microprocessor IC1 [28].

The Performance Test System is activated via Command 3 (described below) and consists of the following tests:

Communication Check:

Using an algorithm, a data frame is sent to each (unique) ID and a response is expected. The maximum waiting time is 150 milliseconds.

A response time>150 milliseconds implies a communication error.

Filament Check

By means of an algorithm, a voltage calculation yields a given result in absolute units. A reading with an absolute value of 0 (zero) in the sensor means that the Filament [12] has been severed.

Absolute Value=0 means Unusable Initiator

Capacitor C7 Initial Status Check [21]:

At system startup, a transistor T4 [22] (FIG. 4) connected to a resistor R12 [22] is activated to connect the positive output of capacitor C7 [08] to ground (Vss or GND) and maintains the capacitor load at a voltage below 1 V. The check of the initial state of capacitor C7 [08] consists of measuring the voltage of capacitor C7 through sensor [28C]. The sensor reads the voltage data from Capacitor C7 [08] and stores it in a 10-bit variable in Microprocessor IC1 [28] equivalent to a given number of 1024 parts. Considering that the initial voltage is in a range between 24V and 35V, one part equals a range between 0.023V and 0.034V; then a range between 30 and 43 parts equals a voltage of less than 1V. The reading after this milestone should be less than 1 V. A reading greater than this value means that either Capacitor C7 [08] is defective or Transistor T4 [22] is defective.

Voltage Capacitor C7 [08]≥1V implies that the Initiator is Unusable.

Capacitor C7 Initial Charge Status Check [31]:

Transistor T4 [22] connected to resistor R12 [22] is deactivated and left ungrounded. Transistor T3 [29] is activated and through resistors R5 and R10 [29], which begins charging Capacitor C7 [08]. The sensor reads and stores data regarding the state of charge of Capacitor C7 [08] every 30 milliseconds during the 30 seconds of the programmed charge. The data is stored in a 10-bit variable in the IC1 microprocessor [28] equivalent to a given number of 1024 parts. At the end of the charging period (30 s), the reading of Capacitor C7 [08] should be greater or equal to 800 parts, a fraction that indicates sufficient voltage to generate the required glow in the filament [12].

Voltage Capacitor C7 [08]<800 parts implies that the Initiator is Unusable.

Programmed Delay Verification:

By means of an algorithm and through a command (Command 3), data regarding the programmed delay is sent from the Command Unit [01] to the Programmable Non-Explosive Electronic Initiator [07] and stored in the non-volatile EEPROM memory of Microprocessor IC1 [28]. The Programmable Non-Explosive Electronic Initiator [07] uses an algorithm to verify that the data sent by the Command Unit [01] is equal to the data received by the Microprocessor IC1 [28]. Microprocessor IC1 [28] sends a response to the Command Unit [01].

The programmed waiting time is 150 milliseconds.

A response time>150 milliseconds implies a communication error.

If the response data concerning the delay is identical to the data sent by the Command Team [01], an acknowledgement code (ACK) is received.

If the response data concerning the delay is different to the data sent by the Command Team [01], an error code is received.

External Oscillator Status Check [25] and Frequency Change for Sleep Mode:

At system startup, the External Oscillator [25] is activated and the pulses per second emitted are read. These pulses must coincide with the frequency of 32 KHz. Once the related data has been recorded in the non-volatile EEPROM memory of Microprocessor IC1 [28], the External Oscillator [25] is deactivated.

Recorded pulses of the External Oscillator [25]=32,000 per second

If the response data concerning pulses is different to 32,000 the Command Team [01], an error code is received.

Microprocessor IC1 [28], which has an internal oscillator of preferably 16 MHz (FIG. 4)—although higher frequency alternatives are not excluded—, has a power consumption of approximately 2 mA (milliamperes). FIG. 6 is a detailed representation of the dynamics generated in Clock Source Block [28A] pertaining to FIG. 4.

This development includes a 32 kHz External Oscillator Q1 [25] (FIG. 4) connected to Microprocessor IC1 [28], whose objective is to reduce power consumption by lowering the system frequency from 16 MHz to 32 KHz.

The Filament [12] (FIG. 4) is made by spiral shaped Tungsten wire with a with length ranging from 1 to 3 mm, preferably 2 mm, 2.2 mm, 2.5 mm, with a diameter ranging from 0.01 mm and 0.1 mm, preferably 0.01, 0.02, 0.03 and with a resistance ranging from 2.5 to 4.5 ohm, preferably 3 ohm, 3.2 ohm, 3.5 ohm, 3.6 ohm, 3.7 ohm, 3.8 ohm and 3.9 ohm.

Figure 3A:
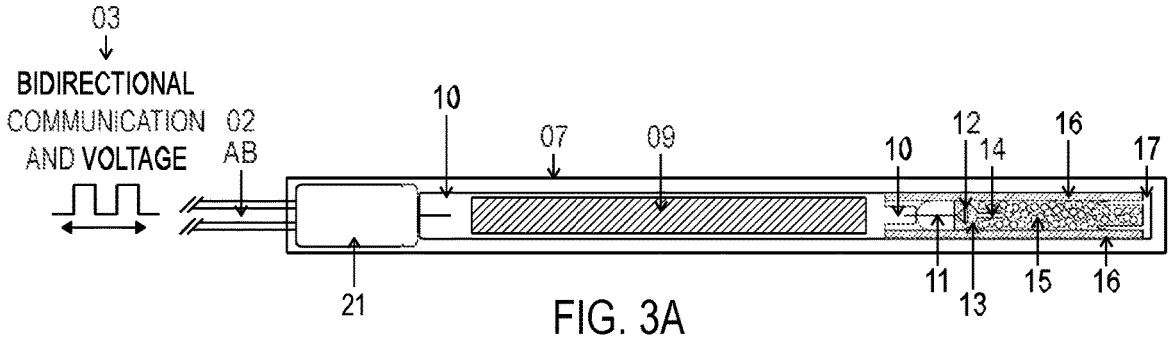
FIG. 3A is a first schematic representation of a Printed Circuit Board (PCB) of the present disclosure.
Figure 3B:
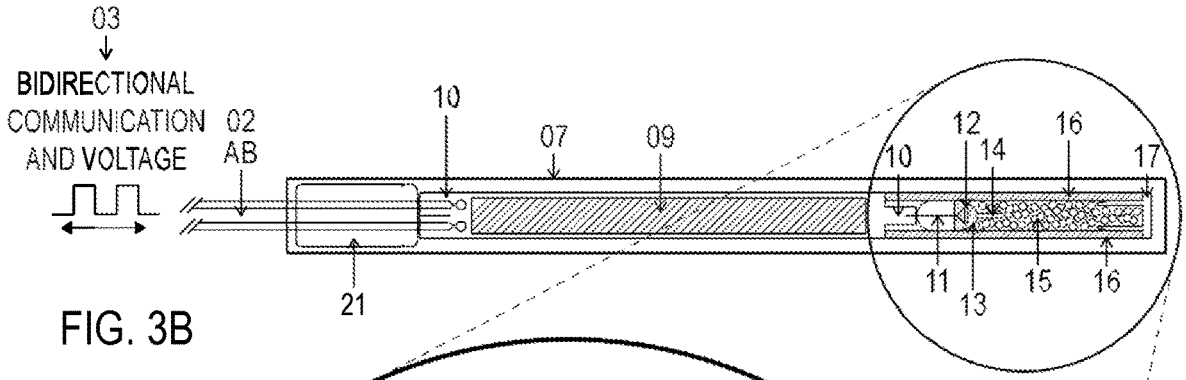
FIG. 3B is a second schematic representation of a Printed Circuit Board (PCB) of the present disclosure.
Figure 3C:
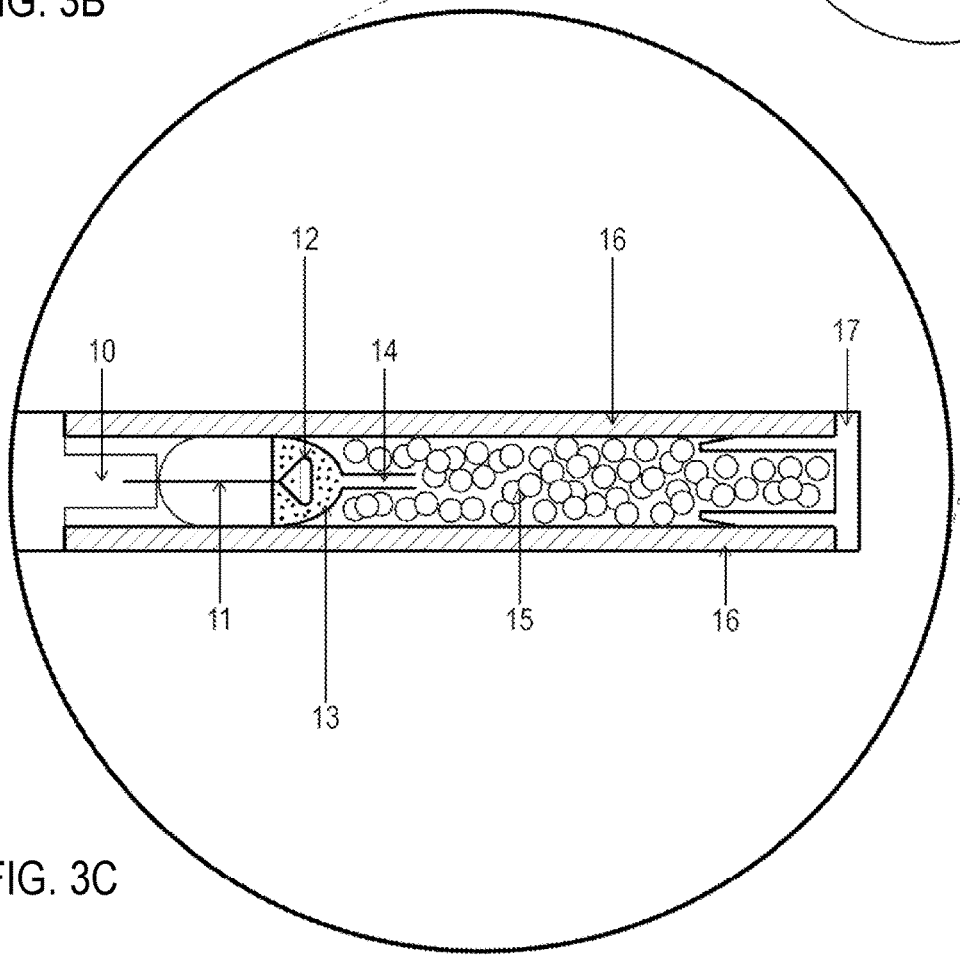
FIG. 3C shows a detail of the interaction between a Filament coated with a Rapidly Expanding Metal Mixture, inserted in a Shrink Sleeve, in accordance with aspects of the present disclosure.

In FIG. 3, which describes the Printed Circuit Board (PCB) [10] including a Printed Circuit [9], the Filament [12] is supported on a solid base [11], covered with a Rapidly Expanding Metal Mixture [13], both inserted in a Shrink Sleeve [14]. It is the Shrink Sleeve [14] that keeps the Filament [12] bound to the Rapidly Expanding Metal Mixture [13]. The Shrink Sleeve [14] is encased by a Capsule container [16] which in turn contains another quantity of a Rapidly Expanding Metal Mixture [15], sealed with a plug [17].

An External Oscillator Q1 [25] of lower frequency than the internal oscillator of the Microprocessor IC1 [28], emits pulses that are read by TIMER1 [37] (FIG. 6). The count of these pulses, performed by TIMER1, is stored and made available for reading by means of an algorithm.

Using an algorithm, the operation of the External Oscillator Q1 [25] is automatically enabled once the internal oscillator of the Microprocessor IC1 [28] becomes disabled. When the internal oscillator of Microprocessor IC1 [28] is turned off and the External Oscillator Q1 [25] starts to operate, the TIMER1 [37] (FIG. 6) of Microprocessor IC1 [28] can read the pulses emitted by it and use an algorithm to associate their equivalence in time.

The delay time is defined in the field and before issuing the Fire command. The defined delay time is programmed in the Programmable Non-Explosive Electronic Initiator(s) [07] through the Command Set [01]. The data related to the programmed delay time is stored in the non-volatile EEPROM memory of the Microprocessor IC1 [28] of each Programmable Non-Explosive Electronic Initiator [07].

The delay time of each Programmable Non-Explosive Electronic Initiator [07] is limited by three characteristics associated with different functionalities.

Capacitor C4 [19] (FIG. 4) plays the role of external battery of Microprocessor IC1 [28] after the line break; the charge autonomy of Capacitor C4 [19] is decisive for the maximum operating time of Microprocessor IC1 [28] once the "Fire" command (Command 7) is activated and the Communication and Power Line [02A and 02B] is cut.

The 32 kHz External Oscillator Q1 [25][25] emits 32,000 pulses per second, these are counted by TIMER1 [37] (FIG. 6) of Microprocessor IC1 [28]. These pulses use an algorithm to time them and count down to the programmed delay time.

Microprocessor IC1 [28] has a sleep mode function, which is activated by an instruction. When entering sleep mode, the TIMER1 oscillator of Microprocessor IC1 [37] is not affected and the peripherals operating from it can continue to operate in sleep mode (FIG. 6); the existence of an External Oscillator Q1 [25], allows to use the "sleep"

function of the IC1 Microprocessor [28] and substantially reduces its power consumption; note that, even though the sleep function could be activated with the internal oscillator of the IC1 Microprocessor [28], its power consumption is 600 nA. Using the External Oscillator Q1 [25] and having activated the "sleep" functionality, this consumption is 20 nA.

Due to the low power consumption obtained with the activation of the External Oscillator Q1 [25], we may achieve a sleep state of more than 64,000 milliseconds due to the activation of the "sleep" function of the Microprocessor IC1 [28] and the autonomy of the Capacitor C4 [19].

All in all, the programmable delay time of each Programmable Non-Explosive Electronic Initiator [07] is limited to a range between 1 and 64,000 milliseconds.

When the programmed delay time (Command 2) is reached, Microprocessor IC1 [28] is interrupted internally, deactivating the "sleep" mode and activating the other functions required to complete the final firing.

The activation of Fire (Command 6), causes the following actions:

a) All the interrupts of Microprocessor IC1 [28] are disconnected to avoid an early awakening of the sleep function.
b) The load of Capacitor C7 [08] is disconnected, so that it maintains its charge at maximum while Microprocessor IC1 [28] is in "sleep" mode and TIMER1 counts down.
c) Information related to the delay time stored in the non-volatile EEPROM memory of Microprocessor IC1 [28] is retrieved and the programmed delay time is loaded into the TIMER1 counter (Command 2).
d) The "sleep" function of Microprocessor IC1 [28] is enabled and only TIMER1 is kept running to start the delay time countdown.
e) The delay time countdown starts.

Once the delay time has elapsed, Capacitor C7 [08] is enabled; at that moment Transistor T2 (NPN) [27] and its Resistor R8 [27] are enabled to discharge all the energy accumulated in Capacitor C7 [08] on the Filament [12] (FIG. 4).

The Filament [12] then begins to glow, generating a temperature of more than 1,200° C. due to the capacitance of Capacitor C7 [08] of between 24V and 35 V and a current of approximately 0.250 A, which activates the Rapidly Expanding Metal Mixture [13] (FIG. 3). This exothermic reaction reaches a temperature greater than 1,200° C., which activates the Rapidly Expanding Metal Mixture [15].

Processes

The Programmable Non-Explosive Electronic Initiator [07] performs the processes described below:

Process 1: The input voltage (24V to 35V) of the Programmable Non-Explosive Electronic Initiator [07] is rectified by means of two capacitors, C1 and C2 [18], a diode D1 and a bridge rectifier D2 [18].

Process 2: Capacitor C3 [20] keeps the input voltage stable (24V and 35V). The voltage regulator IC2 [20], lowers the input voltage (24V and 35V) to 5V, the input voltage for diodes D4 and D5 [19].

Process 3: The data enters the Programmable Non-Explosive Electronic Initiator [07] through resistors R1 and R2 [24] (FIG. 04). These resistors filter (separate) the byte frame associated with the incoming data and reduce its input voltage (between 24V and 35V) to the level required by the IC1 microprocessor [28] (between 3.3V and 5.0V).

Process 4: Two diodes D4 and D5 [19] are placed on the voltage input line to the IC1 microprocessor [28]. These components regulate the voltage to the one required by the IC1 microprocessor [28] (3.6V) and stop the current leakage. Also, a 470 uF Capacitor C4 [19] is placed on the input voltage line to the IC1 Microprocessor [28], which keeps the input voltage stable (3.6V). Capacitor C4 [19] also fulfills the role of an energy accumulator.

Process 5: Microprocessor IC1 [28] has a PIN configured as a sensor. The sensor is connected to two resistors R6 and R7 [26], which play the role of voltage divider, between Capacitor C7 [08], Filament [12] and ground (VSS).

The sensor [28C] (FIG. 4) reads the data resulting from the Filament continuity check (Command 3). The resistance value is expected to be between 2.5 and 4.5 ohm.

Using an algorithm, the IC1 microprocessor sensor [28] reads the initial charge state of Capacitor C7 [08]. The first sampling is expected to be less than 1V (Command 3).

Process 6: Microprocessor IC1 [28] deactivates Transistor T4 [22], activates the PIN connected to Transistor T3 [29] through Resistors R10 and R5 [29]. This allows the charging of Capacitor C7 [08] to be initiated. The charging process of Capacitor C7 [08] is programmed for 30 seconds.

Process 7: The IC1 Microprocessor sensor [28] records charge voltage data every 30 milliseconds during the 30 seconds of charging Capacitor C7 [08]. The generated data are stored in a non-volatile EEPROM memory of the IC1 microprocessor [28]. The data will be processed via Command 3, indicated further below.

Process 8: Capacitor C7 [08] is connected to the rectified power line (Process 1). Resistor R9 [21] and diode D3 [21] limit the system load. A slow charging of Capacitor C7 [08] (30 sec) and a current consumption between 2 and 3 milliamps is generated.

Process 9: Connected to Microprocessor IC1 [28], External Oscillator Q1 [25] and Capacitors C5 and C6 [25] keep the 32 kHz oscillation stable.

Process 10: The output Transistor T1 [23] and Resistors R3 and R4 [23] send the response frame once the commands (indicated below) have been processed through the bidirectional communication protocol (FIG. 2).

Process 11: Microprocessor IC1 [28] activates transistor T2 [27] through Resistor R8 [27]. Capacitor C7 [08] discharges through the Filament [12], causing the Filament [12] to glow.

Process 12: The glowing Filament [12] reaches a temperature above 1,000° C. and activates the Rapidly Expanding Metal Mixture [13] (FIG. 3).

Process 13: The exothermic reaction of the activation of the Rapidly Expanding Metal Mixture [13] allows reaching a temperature of 1,200 C and activates the Rapidly Expanding Metal Mixture [15].

Commands

Command 1: Records the ID, the RFID identifier code [05], in the non-volatile EEPROM memory of the IC1 microprocessor [28], which uniquely identifies a Programmable Non-Explosive Electronic Initiator [07].

Command 2: It saves in the non-volatile EEPROM memory of Microprocessor IC1 [28] the programmed delay time, which varies between 1 millisecond and 64,000 milliseconds.

Command 3: Query ID. It diagnoses the current functionality, except for Command 7 (Fire).

Diagnosis 1: An algorithm is used to test the response time of the Programmable Non-Explosive Electronic Initiator [07]. If the response time exceeds a programmed time limit (100 milliseconds), it responds with an error code.

Diagnosis 2: A sensor is used to check that the charge in Capacitor C7 [08] from 470 uF to 2,200 uF is less than 1 V (Volt). In case of failure, it responds with an error code. In case of error, transistor T4 [22] is activated and forces capacitor C7 [08] to ground (Vss or GND).

Diagnosis 3: A sensor is used to check that the filament [12] has continuity between 2.5 and 4.5 ohm. In case of failure, it responds with an error code. In case of error, transistor T4 [22] is activated and forces capacitor C7 [08] to ground (Vss or GND).

Diagnosis 4: An algorithm is used to retrieve the data associated with the programmed delay stored in the non-volatile EEPROM memory of the IC1 microprocessor [28]. The data is checked to ensure that it matches the data to the programmed delay time sent by the Command Equipment [01]. In case of failure, it responds with an error code.

Diagnosis 5: An algorithm is used to retrieve the data associated with the frequency of the External Oscillator [25], stored in the non-volatile EEPROM memory of Microprocessor IC1 [28] at the start of the system. If the register shows an error, transistor T4 [22] is activated and forces capacitor C7 [08] to discharge to ground (Vss or GND).

Command 4: Allows change of location of one (or more) Programmable Non-Explosive Electronic Initiator [07]. Allows to modify the delay assignment of one (or more) Programmable Non-Explosive Electronic Initiator [07]. Allows manual reprogramming of one (or more) Programmable Non-Explosive Electronic Initiators [07].

Command 5: Preparation before firing. Disable Transistor T4 [22] to exit the grounded state. Enables Transistor T3 [29] to proceed with charging Capacitor C7 [08] over a 30 second time period; reads and stores the charge data of Capacitor C7 [08] every 30 milliseconds during the 30 second charge. Stored data is available for reading in a variable of Microprocessor IC1 [28]. Disables the internal oscillator (16 Mhz) of Microprocessor IC1 [28] and enables the External Oscillator [25] (32 KHz).

At this point, the user must repeat Command 3 to check again that the system is operational including the status change of Capacitor C7 [08].

Command 6: Safety measure in case of any failure. If Command 5 fails, it responds with an error code, Transistor T4 [22] is activated, connecting Capacitor C7 [08] to ground and discharging it.

Command 7: Fire. Disables external interrupts of the microprocessor [28]. Disables the charging of Capacitor C7 [08]. TIMER1 is loaded with the data related to the delay time. Activates the "sleep" function of Microprocessor IC1 [28]. Enables countdown of the assigned delay time of the Programmable Non-Explosive Electronic Initiator [07]. At the end of the countdown assigned to the programmed delay time, activates Capacitor C7 [08]. Activates I/O output PORT C5 [40] (FIG. 7) of Microprocessor IC1 [28] and Transistor T2 [27].

LISTING OF REFERENCE NUMBERS

In order to better describe the figures, below is a list of all the items shown in them:

[01] Command Equipment (Console or Master)
[02A] Communication and Power Line
[02B] Communication and Power Line (VSS or GND)
[03] Voltage Modulation
[04] Connector
[05] External RFID card
[06] Logger, RFID Reader
[07] Programmable Non-Explosive Electronic Initiator
[08] Capacitor C7
[09] Printed Circuit
[10] Printed Circuit Board (PCB)
[11] Solid filament base
[12] Filament
[13] First metallic mixture
[14] Shrink Sleeve
[15] Second metallic mixture
[16] Container capsule
[17] Container capsule plug
[18] D2, C1, C2, D1 Voltage Rectifier Block
[19] IC1, D4, D5, C4 Microcontroller Voltage input block
[20] IC2, C3, Voltage Regulator Block
[21] C7, D3, R9 Capacitor charging and discharging block
[22] C7, R11, R12 Capacitor Discharge Block
[23] T1, R3, R4 data to communication line transmitter block
[24] Voltage divider block with data to block 28D (INT), R1, R2
[25] Q1, C5, C6 External Oscillator Block
[26] 28C, R6, R7 voltage divider block to ADC block sensor
[27] T2, R8 Firing Regulator Block
[28] IC1 Microcontroller Block
[28A] Clock Source
[28B] I/O input and output ports
[28C] Sensor Input (ADC Analog to Digital)
[28D] Interruption when entering data through the port
[28E] TX transmission serial data output (UART)
[28F] CPU Function and data storage processor
[29] C7, T3, R10, R5 Capacitor load activation block
[31] IC1 Microcontroller Programming Socket
[32] IC1 Microcontroller Programming Flash Memory
[33] CPU with its internal peripherals attached
[34] External Oscillator and time generator connection block to the CPU
[35] CPU-connected peripheral bus
[36] Clock source of IC1 microcontroller, OSC (External Oscillator)
[37] Pulse source for TIMER1 counter from OSC Q1.
[38] Output I/O port for charging Capacitor C7 (28B FIG. 4)
[39] Output I/O Port for discharging Capacitor C7 (28B FIG. 4)
[40] Output I/O Port for firing, discharge of Capacitor C7 on Filament [12] (28B FIG. 4)
[41] Input I/O port via interrupt (INT), for data processing (28D FIG. 4)
[42] Input to the ADC module, for the voltage sensor. (28C FIG. 4)
[43] Serial transmission output PIN TX (UART) (28E FIG. 4)

FIG. 1

Figure 1A:
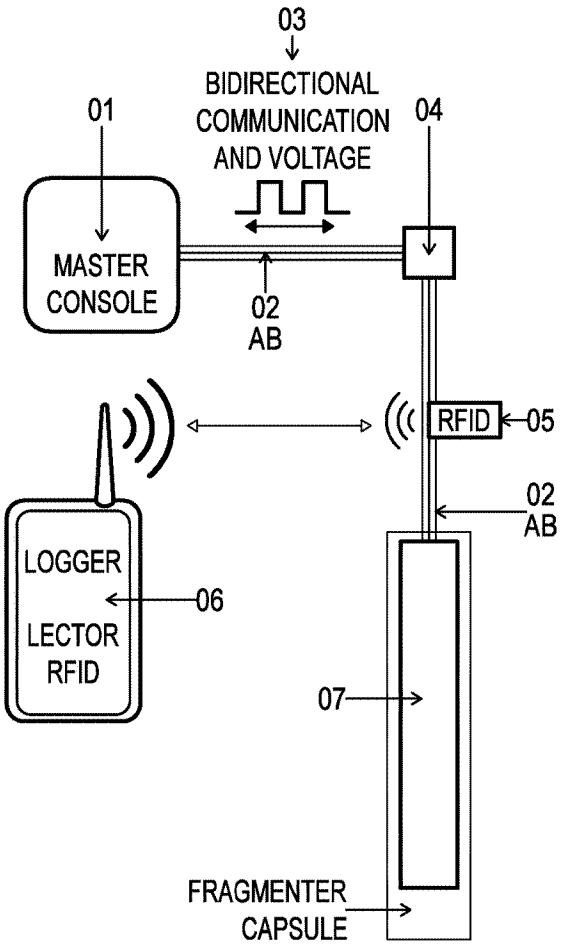
FIG. 1A depicts an arrangement of elements of the present system using a single parallel Communication and Power line for a single Programmable Non-Explosive Electronic Initiator and an RFID reader that reads the unique identifier code ID of the Programmable Non-Explosive Electronic Initiator.

This figure shows two diagrams, A and B, where the left diagram or FIG. 1A shows the arrangement of the elements of the present system using a single parallel Communication and Power line [02A and 02B] for a single Programmable Non-Explosive Electronic Initiator [07] and an RFID reader that reads the unique identifier code ID of the Programmable Non-Explosive Electronic Initiator [07]. Diagram B, or FIG. 1B, shows the present system using a single parallel Communication and Power line [02A and 02B] for four or more Programmable Non-Explosive Electronic Initiators [07].

FIG. 2

This figure shows three diagrams A, B and C, representing voltage waves, where FIG. 2A, above, shows the beginning of the bidirectional communication, where the Voltage Modulation [03] sent consists of a constant square wave with a defined amplitude between 24V and 35V and a period of 4.0 ms. The high bit of 4 milliseconds and the low bit of 0.2 milliseconds allow for a constant voltage to be maintained.

FIGS. 2B and 2C present diagrams showing the details of a bidirectional communication protocol with a transmission rate of 2,400 bits per second that is used in the Communication and Power Line [02A and 02B].

FIG. 3

This figure shows three diagrams: A, B and C, where the first two show a schematic description of the Printed Circuit Board (PCB). Diagram C shows a detail of the interaction between Filament [12] coated with a Rapidly Expanding Metal Mixture [13], inserted in a Shrink Sleeve [14], where the Shrink Sleeve [14] holds together the Filament [12] with the Rapidly Expanding Metal Mixture [13], and where the Shrink Sleeve [14] is contained by a Capsule container [16] which in turn contains another amount of a Rapidly Expanding Metal Mixture [15].

FIG. 4

This figure shows a schematic circuit of the Programmable Non-Explosive Electronic Initiator [07].

FIG. 5

This figure shows a specification of the CPU programming and feedback [28F] described in the schematic circuit of the Programmable Non-Explosive Electronic Initiator [07].

FIG. 6

This figure is a detailed representation of the dynamics generated in the Clock Source Block [28A].

FIG. 7

This figure shows a diagram of how the square wave with the data is transmitted from the Command Unit [01] to the INT/IO PORT input pin [41] and IO output ports [28B](for charging Capacitor C7 [38], for discharging Capacitor C7 [39], for firing and discharging Capacitor C7 in Filament [12][40]) (FIG. 4) of the IC1 Microprocessor [28], converting it into bytes with the use of an algorithm. On the other hand, FIG. 7 refers to PINs C0, C3, C5 of the IC1 microcontroller in FIG. 4.

FIG. 8

This figure shows a diagram of the analog information received by the Microprocessor IC1 [28] through the ADC/AN pin [42] (FIG. 4) [28C] where it is converted to digital for sensor readout.

FIG. 9

This figure shows a diagram of how Microprocessor IC1 [28], through the USART transmission block pin TX [43] (FIG. 4) [28E], transmits the output data, where the output data is inserted through a transistor T1 and two resistors R3 and R4 [23] in the Communication and Power Line [02A and 02B].

Example of Application

In order to calculate the ignition temperature of the primary metallic mixture, the following mixture Al+Fe2O3+NaNO3(Aluminum+Iron Oxide+Sodium Nitrate) was used, using the following equations:

The resistivity of a metal (p) increases with temperature; this relationship is determined by the following equation:

$$\rho(T)=\rho_o(1+\alpha(\Delta T)) \quad \text{(Equation No. 1)}$$

Where:

ρ(T)=Resistivity of a metal as a function of a temperature differential.

$\rho_o$=Initial metal resistivity.

α=Temperature coefficient per centigrade degree of the metal.

ΔT=Temperature differential ($T_{Final}-T_{initial}$).

In turn, the resistivity of a metal is directly proportional to the resistance of the metal, the relationship between the two is given by:

$$R=\rho*L/A \quad \text{(Equation No. 2)}$$

Where:

R=Metal resistance

ρ=Metal resistivity

L=Length of metal wire

A=Wire surface

Knowing the values at an ambient temperature of To=20° C. and Ro at that temperature equal to 10.5Ω, the temperature coefficient (α) of tungsten is α=0.0045. If we do an experimental calculation of the RF resistance of tungsten, we get, when applying a voltage of V=24 V (volts), 20V calculated by the voltage drop and an electric current I=0.100 A (amperes) and substituting the resistivity (p) of equation No. 2 in equation No. 1.

$$\rho=R*A/L \quad \text{(Equation No. 2)}$$

$$(R*A(T))/L=(R_o*A(1+\alpha(T_F-T_o)))/L \quad \text{(Equation No. 1)}$$

Multiplying both members by L/A $$(R*A(T)*L)*(L/A)=(R_o*A(1+\alpha(T_F-T_o)))*(L/A)$$

$$R(T)=R_o(1+\alpha(T_F-T_o)) \quad \text{(Equation No. 3)}$$

Where:

R(T)=Resistance of the metal to a temperature variation.

$R_o$=Metal resistance at $T_o$

α=Temperature coefficient per centigrade degree of the metal.

$T_F$=Temperature variation with respect to the initial temperature $T_o$=Initial metal temperature Determining variable $T_F$ from equation No. 3:

$$T_F=((R_F/R_o)-1)/\alpha+T_o \quad \text{(Equation No. 4)}$$

Calculating experimentally with the discharge of capacitor C7 gives us a final resistance per temperature difference of 90 ohm, substituting these values in equation No. 4:

$$T_F=((900/10.5\Omega)-1)/0.0045+20^\circ\ \text{C.}$$

$$T_F=1{,}702^\circ\ \text{C.}$$

Based on the results obtained, it is concluded that at an ambient temperature of 20° C., the filament temperature for igniting the first rapidly expanding metallic mixture [13] is approximately 1,702° C.

Considering that the melting point of tungsten metal is 3,422° C., it is concluded that the filament will not break before activating the first rapidly expanding metallic mixture [13].

Since the filament incandescence has a time limit, in an environment exposed to oxygen (no vacuum) its consumption is inevitable. Once the discharge of capacitor C7 is activated, the minimum average glow period of filament [12] is greater than 100 milliseconds, enough time for the glow of filament [12] to activate the first rapidly expanding metallic mixture [13].

The invention claimed is:

1. A programmable non-explosive electronic initiator, the electronic initiator comprising:

a capsule, the capsule comprising a container tube or sleeve closed by a sealing plug and containing a first rapidly expanding metallic mixture;

wherein the capsule is configured to receive a communication having a voltage-modulated, bidirectional communication protocol from an external command equipment via a communication and power line using a bidirectional serial algorithm;

a filament supported on a solid base wherein the filament is coated by a second rapidly expanding metallic mixture;

a shrink sleeve contained in the container tube or sleeve, wherein the shrink sleeve is configured to hold the filament and the solid base;

a first capacitor having a voltage requirement under 35V, wherein a controlled discharge of the first capacitor is configured to cause the filament to glow; and a printed circuit board (PCB) comprising a printed circuit, wherein the printed circuit is configured to control the controlled discharge of the first capacitor, wherein control of the controlled discharge comprises a delay of 1 ms to 64,000 ms.

2. The electronic initiator according to claim 1, wherein the printed circuit comprises:

a microprocessor comprising a unique and unrepeatable identification code (ID), wherein the microprocessor is configured to receive the communication process a trigger command to activate the programmable non-explosive electronic initiator, wherein the microprocessor comprises a non-volatile Electrically Erasable Programmable Read-Only Memory (EEPROM) configured to store the, a delay parameter, and an internal oscillator;

a pin configured to sense a charge state of the first capacitor and a continuity of the filament;

a flash microcontroller;

a programming unit of Rapid Access Memory (RAM) coupled to the microprocessor;

a second capacitor configured to maintain stability and autonomy of an input voltage to the microprocessor in response to the microprocessor receiving the trigger command; and an external oscillator coupled to the microprocessor, wherein the external oscillator includes a lower oscillation frequency than the internal oscillator of the microprocessor, wherein the external oscillator is configured to deliver pulses to a timer of the microprocessor.

3. The electronic initiator according to claim 2, wherein the second capacitor includes a capacitance above 300 μF of tantalum.

4. The electronic initiator according to claim 2, wherein the external oscillator has a frequency of 32,000 Hertz;

wherein the trigger command is configured to deactivate the internal oscillator of the microprocessor and activate the external oscillator;

wherein the activation of the external oscillator is configured to reduce a frequency and power consumption of the microprocessor by 250 to 500 times;

wherein the activation of the external oscillator in combination with an activation of a sleep function of the microprocessor is configured to reduce power consumption from mA to nA, such that a programmable delay time of 64,000 milliseconds is achieved.

5. The electronic initiator according to claim 2, wherein the timer is configured to count pulses delivered by the external oscillator and determine a time duration, wherein the time duration is stored wherein 32 pulses delivered by the external oscillator and read by the timer are equivalent to 1 ms.

6. The electronic initiator according to claim 1, wherein an input/output (I/O) port pin in the microprocessor is configured to activate a transistor, wherein the transistor is configured to charge the first capacitor.

7. The electronic initiator according to claim 1, wherein the filament is configured to reach a temperature sufficient to activate the second rapidly expanding metallic mixture in response to the controlled discharge of the first capacitor.

8. The electronic initiator according to claim 1, wherein the electronic initiator further comprises a resistor, wherein the resistor and the first capacitor are connected in series, and wherein the resistor is configured to slow a charging rate of the first capacitor.

9. The electronic initiator according to claim 1, wherein the electronic initiator comprises:

a plurality of electronic initiator units connected in parallel;

wherein the plurality of electronic initiator units, the communication and power line, and the external command equipment are configured to communicate through a square wave frame, such that the plurality of electronic initiator units are synchronized in time.

10. A method for operating the programmable non-explosive electronic initiator of claim 1, the method comprising:

i) checking for a communication failure between the command equipment and the programmable electronic non-explosive initiator;

ii) checking a charge state of the first capacitor, wherein in response to an error, a transistor is activated and the first capacitor is discharged to ground;

iii) checking the continuity of the filament, wherein in response to an error, the transistor is activated and the first capacitor is discharged to ground;

iv) checking a delay time value programmed in an Electrically Erasable Programmable Read-Only Memory (EEPROM) of the microprocessor;

v) disconnecting interrupts on the microprocessor to maintain the microprocessor in a sleep mode;

vi) disconnecting a load on the first capacitor, such that the first capacitor maintains charge at maximum while the microprocessor is in the sleep mode and a timer counts down from the delay time value;

vii) discharging the first capacitor to ground through a filament such that the filament glows, in response to the timer countdown reaching zero;

viii) activating the second rapidly expanding metallic mixture, compressing the filament and the second rapidly expanding metallic mixture by a shrink sleeve, wherein a resulting temperature rise is sufficient to activate the first rapidly expanding metallic mixture; and ix) causing an exothermic reaction between the programmable non-explosive electronic initiator and the first rapidly expanding metallic mixture.

* * * * *